US010712680B2

(12) United States Patent
Yoshida et al.

(10) Patent No.: US 10,712,680 B2
(45) Date of Patent: Jul. 14, 2020

(54) WHITE TONER FOR ELECTROSTATIC IMAGE DEVELOPMENT, ELECTROSTATIC IMAGE DEVELOPER, TONER CARTRIDGE, PROCESS CARTRIDGE, IMAGE FORMING APPARATUS, AND IMAGE FORMING METHOD

(71) Applicant: FUJI XEROX CO., LTD., Tokyo (JP)

(72) Inventors: Kana Yoshida, Minamiashigara (JP); Shinya Sakamoto, Minamiashigara (JP)

(73) Assignee: FUJI XEROX CO., LTD., Tokyo (JP)

( * ) Notice: Subject to any disclaimer, the term of this patent is extended or adjusted under 35 U.S.C. 154(b) by 12 days.

(21) Appl. No.: 15/995,206

(22) Filed: Jun. 1, 2018

(65) Prior Publication Data

US 2019/0196347 A1 Jun. 27, 2019

(30) Foreign Application Priority Data

Dec. 22, 2017 (JP) ..... 2017-246592

(51) Int. Cl.

*G03G 9/08* (2006.01)
*G03G 9/087* (2006.01)
*G03G 9/09* (2006.01)

(52) U.S. Cl.

CPC ..... *G03G 9/087* (2013.01); *G03G 9/0819* (2013.01); *G03G 9/0821* (2013.01); *G03G 9/08755* (2013.01); *G03G 9/08797* (2013.01); *G03G 9/0902* (2013.01); *G03G 9/0926* (2013.01)

(58) Field of Classification Search

CPC .... G03G 9/087; G03G 9/0819; G03G 9/0926; G03G 9/0821

See application file for complete search history.

(56) References Cited

U.S. PATENT DOCUMENTS

2012/0189950 A1* 7/2012 Sugitate ..... G03G 9/09708 430/105
2015/0253685 A1* 9/2015 Suzuki ..... G03G 9/0821 430/105

FOREIGN PATENT DOCUMENTS

JP 4525506 B2 8/2010

OTHER PUBLICATIONS

Machine Translation of JP2007-033719, publication date Aug. 2007, pp. 1-19.*

* cited by examiner

*Primary Examiner* — Mark A Chapman
(74) *Attorney, Agent, or Firm* — Oliff PLC

(57) ABSTRACT

A white toner for electrostatic image development includes toner particles containing a binder resin, which contains at least a crystalline polyester resin and an amorphous polyester resin, and a white pigment. The loss tangent tan δ at 30° C. determined by dynamic viscoelasticity measurement is 0.2 or more and 1.0 or less.

13 Claims, 3 Drawing Sheets

WHITE TONER FOR ELECTROSTATIC IMAGE DEVELOPMENT, ELECTROSTATIC IMAGE DEVELOPER, TONER CARTRIDGE, PROCESS CARTRIDGE, IMAGE FORMING APPARATUS, AND IMAGE FORMING METHOD

CROSS-REFERENCE TO RELATED APPLICATIONS

This application is based on and claims priority under 35 USC 119 from Japanese Patent Application No. 2017-246592 filed Dec. 22, 2017.

BACKGROUND

(i) Technical Field

The present invention relates to a white toner for electrostatic image development, an electrostatic image developer, a toner cartridge, a process cartridge, an image forming apparatus, and an image forming method.

(ii) Related Art

In an electrophotographic system for forming images, there is proposal of a method of forming a white image as a base with a white toner on a recording medium and forming a colored image with a colored toner on the base.

SUMMARY

According to an aspect of the invention, there is provided a white toner for electrostatic image development, the toner including toner particles containing a binder resin, which contains at least a crystalline polyester resin and an amorphous polyester resin, and a white pigment. The loss tangent tan δ at 30° C. determined by dynamic viscoelasticity measurement is 0.2 or more and 1.0 or less.

BRIEF DESCRIPTION OF THE DRAWINGS

Exemplary embodiments of the present invention will be described in detail based on the following figures, wherein.

DETAILED DESCRIPTION

Figure 1:
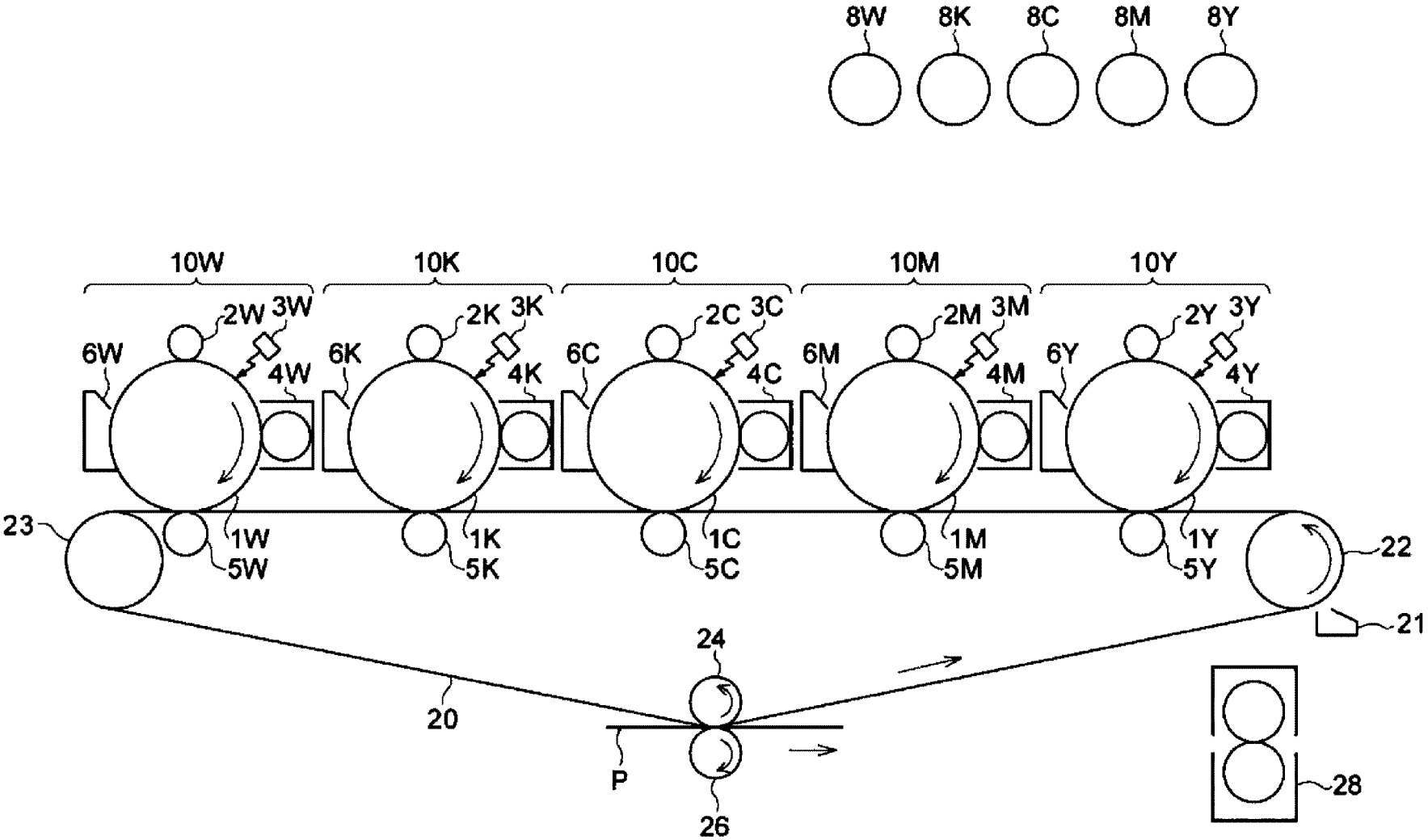
FIG. 1 is a schematic configuration diagram showing an example of an image forming apparatus according to an exemplary embodiment of the present invention.

Exemplary embodiments of the present invention are described below.

<White Toner for Electrostatic Image Development>

A white toner for electrostatic image development (also simply referred to as a "white toner" or a "toner" hereinafter) according to an exemplary embodiment of the present invention contains a binder resin, which contains at least a crystalline polyester resin and an amorphous polyester resin, and a white pigment.

The loss tangent tan δ at 30° C. determined by dynamic viscoelasticity measurement is 0.2 or more and 1.0 or less.

The white toner according to the exemplary embodiment having the configuration described above can suppress light transmission of a formed white image. The reason for this is supposed as follows.

In general, a white image may be formed with a white toner for the purpose of forming a white base on a colored recording medium such as color paper, colored paper (for example, black paper), or the like. Also, a white toner may be used for the purpose of forming a white base on a transparent recording medium such as a transparent film or the like.

In general, a colored image is formed on the white image serving as the white base. In addition, the white image is required to have hiding properties, that is, low light transparency, in order to enhance clarity of the colored image formed on the white image.

The white toner according to the exemplary embodiment has the loss tangent tan δ at 30° C. within the range described above.

The loss tangent tan δ at 30° C. determined by dynamic viscoelasticity measurement refers to a ratio of storage modulus to loss modulus, and in the toner particles containing a crystalline polyester resin and an amorphous polyester resin, the loss tangent tan δ is correlated with the dispersion state of the crystalline polyester resin in the amorphous polyester resin. The higher dispersion state of the crystalline polyester resin tends to increase the loss tangent tan δ by the plasticizing effect of the crystalline polyester resin, while the lower dispersion state of the crystalline polyester resin tends to decrease the loss tangent tan δ.

The loss tangent tan δ within the range is considered to represent that the toner particles containing the amorphous polyester resin and the crystalline polyester resin has high loss tangent tan δ, that is, a high dispersibility state of the crystalline polyester resin.

The crystalline polyester resin generally has lower light transparency than the amorphous polyester resin. In the exemplary embodiment, the white toner has a high loss tangent tan δ, that is, high dispersibility of the crystalline polyester resin dispersed in the white toner particles, and thus the crystalline polyester resin is present in a high dispersion state also in the formed white image. Therefore, the light transparency of the white image can be considered to be decreased, thereby improving the hiding properties and whiteness.

Also, it is considered that when the dispersibility of the crystalline polyester resin is excessively increased, the domain diameter of the crystalline polyester resin is decreased, and thus conversely the light transparency is increased. Therefore, it is considered that in the exemplary embodiment, because the loss tangent tan δ of the white toner is within the range described above, the dispersion state of the crystalline polyester resin does not become excessive, and thus the low light transparency of the white image can be realized, thereby improving the hiding properties and whiteness.

Loss Tangent Tan δ

In the white toner according to the exemplary embodiment, the loss tangent tan δ at 30° C. determined by dynamic viscoelasticity measurement is 0.2 or more and 1.0 or less. The loss tangent tan δ is preferably 0.3 or more and 0.9 or less and more preferably 0.35 or more and 0.85 or less.

When the loss tangent tan δ of the white toner is within the range of 0.2 or more and 1.0 or less, the light transparency of the formed white image can be suppressed.

Storage Modulus G'

In the white toner according to the exemplary embodiment, the storage modulus G' at 30° C. determined by dynamic viscoelasticity measurement is preferably $1.0\times10^8$ Pa or more and $5.0\times10^8$ Pa or less. The storage modulus G' is more preferably $1.5\times10^8$ Pa or more and $4.5\times10^8$ Pa or less and still more preferably $1.8\times10^8$ Pa or more and $4.2\times10^8$ Pa or less.

When the storage modulus G' of the white toner is within the range of $1.0\times10^8$ Pa or more and $5.0\times10^8$ Pa or less, the dispersibility of the crystalline polyester resin in the amorphous polyester resin is considered to be increased, while the dispersion state does not become excessive. As a result, the light transparency of the formed white image can be easily suppressed.

Here, dynamic viscoelasticity measurement is described.

The loss tangent tan δ (tan. Delta: mechanical loss tangent of dynamic viscoelasticity) determined by dynamic viscoelasticity measurement is defined as G"/G' wherein G" and G' are the loss modulus and storage modulus, respectively, determined by measuring the temperature dependence of dynamic viscoelasticity. Here, G' is an elastic response component of elastic modulus in a relation between generated stress and strain during deformation, and the energy for deformation work is stored. A viscous response component of elastic modulus is G". The tan δ defined by G"/G' becomes a measure for the ratio between energy loss to energy storage in a deformation work.

The dynamic viscoelasticity is measured by a rheometer.

Specifically, the toner to be measured is molded into a tablet at room temperature (for example, 25° C.) by using a press molding machine to form a sample for measurement. By using the sample for measurement, the tan δ is determined by the dynamic viscoelasticity measurement using the rheometer under the following conditions.

Measurement Conditions

Measurement apparatus: Rheometer ARES (manufactured by TA Instruments Inc.)

Measurement jig: 8-mm parallel plate

Gap: adjusted to 4 mm

Frequency: 1 Hz

Measurement temperature: increased to 110° C. or more and then kept at 30° C. for 60 minutes before measurement.

Strain: 0.03 to 20% (automatic control)

Heating rate: 1° C./min

The reason for measuring the loss tangent tan δ and storage modulus G' at a temperature of 30° C. is that the phase separation between the amorphous polyester resin and the crystalline polyester resin is maintained at the temperature, and the temperature is suitable for evaluating dispersibility.

Each of a method for controlling the loss tangent tan δ of the white toner within the range described above and a method for controlling the storage modulus G' of the white toner within the range described above is, for example, a method of properly adjusting a degree of dispersion while enhancing the dispersibility of the crystalline polyester resin in the toner particles.

A specific example of the method is described later.

Domain Diameter

For the white toner according to the exemplary embodiment, it is effective to control the domain diameter of the crystalline polyester resin in the toner particles.

The excessively large domain diameter of the crystalline polyester resin may degrade the dispersion state of the crystalline polyester resin in the amorphous polyester resin and thus the light transmission of the formed white image cannot be easily suppressed. On the other hand, the excessively small domain diameter of the crystalline polyester resin shows that micro-dispersion becomes excessive, and thus also the light transmission of the formed white image cannot be easily suppressed.

A method for controlling the domain diameter of the crystalline polyester resin is, for example, a method of Properly adjusting a degree of dispersion while enhancing the dispersibility of the crystalline polyester resin in the toner particles.

A specific method is described later.

Details of the toner according to the exemplary embodiment are described below.

The toner according to the exemplary embodiment includes toner particles and, if required, additives.

(Toner Particle)

The toner particles contain, for example, a binder resin and a white coloring agent, and if rewired, a mold release agent and other additives.

Binder Resin

At least a crystalline polyester resin and an amorphous polyester resin are used as the binder resin.

The total ratio of the crystalline polyester resin and the amorphous polyester resin to the whole binder resin is preferably 40% by mass or more, more preferably 45% by mass or more, and preferably as close to 100% by mass as possible.

Examples of another binder resin which can be used in combination with the crystalline polyester and the amorphous polyester resin include vinyl resins made of homopolymers of monomers or copolymers of combination of two or more of the monomers, such as styrenes (for example, styrene, parachlorostyrene, α-methylstyrene, and the like), (meth)acrylic acid esters (for example, methyl acrylate, ethyl acrylate, n-propyl acrylate, n-butyl acrylate, lauryl acrylate, 2-ethylhexyl acrylate, methyl methacrylate, ethyl methacrylate, n-propyl methacrylate, lauryl methacrylate, 2-ethylhexyl methacrylate, and die like), ethylenically unsaturated nitriles (for example, acrylonitrile, methacrylonitrile, and the like), vinyl ethers (for example, vinyl methyl ether, vinyl isobutyl ether, and the like), vinyl ketones (for example, vinyl methyl ketone, vinyl ethyl ketone, vinyl isopropenyl ketone, and the like), olefins (for example, ethylene, propylene, butadiene, and the like), and the like.

Other examples of the other binder resin include non-vinyl resins such as epoxy resins, polyurethane resins, polyamide resin, cellulose resins, polyether resins, modified rosin resins, and the like, a mixture of the non-vinyl resin with the vinyl resin, graft polymers produced by polymerizing vinyl monomers in the coexistence of any one of these resins, and the like.

These other binder resins may be used alone or in combination of two or more.

The "crystalline" of the resin represents having a clear endothermic peak, not a stepwise change in endothermic quantity, in differential scanning calorimetry (DSC), and specifically represents that the half-width of an endothermic peak in measurement at a heating rate of 10 (° C./min) is within 10° C.

On the other hand, the "amorphous" of the resin represents that the half-width exceeds 10° C., that a stepwise change in endothermic quantity is shown, or that a clear endothermic peak is not observed.

Amorphous Polyester Resin

The amorphous polyester resin is, for example, a condensation polymer of a polyhydric carboxylic acid and a polyhydric alcohol. The amorphous polyester resin used may be a commercial product or a synthesized product.

Examples of the polyhydric carboxylic acid include aliphatic dicarboxylic acids (for example, oxalic acid, malonic acid, maleic acid, fumaric acid, citraconic acid, itaconic acid, glutaconic acid, succinic acid, alkenylsuccinic acid, adipic acid, sebacic acid, and the like), alicyclic dicarboxylic acids (for example, cyclohexane dicarboxylic acid and the like), aromatic dicarboxylic acids (for example, terephthalic acid, isophthalic acid, phthalic acid, naphthalene dicarboxylic acid, and the like), and anhydrides or lower (for example, 1 or more and 5 or less carbon atoms) alkyl esters thereof. Among these, for example, an aromatic dicarboxylic acid is preferred as the polyhydric carboxylic acid.

The dicarboxylic acid may be used in combination with a tri- or higher-hydric carboxylic acid having a crosslinked structure or branched structure as the polyhydric carboxylic acid. Examples of the tri- or higher-hydric carboxylic acid include trimellitic acid, pyromellitic acid, anhydrides or lower (for example, 1 or more and 5 or less carbon atoms) alkyl esters thereof, and the like.

The polyhydric carboxylic acids may be used alone or in combination of two or more.

Examples of the polyhydric alcohol include aliphatic diols (for example, ethylene glycol, diethylene glycol, triethylene glycol, propylene glycol, butanediol, hexanediol, neopentyl glycol, and the like), alicyclic diols (for example, cyclohexanediol, cyclohexane dimethanol, hydrogenated bisphenol A, and the like), aromatic dials (for example, bisphenol A ethylene oxide adduct, bisphenol A propylene oxide adduct, and the like), and the like. Among these, the polyhydric alcohol is preferably an aromatic diol or alicyclic dial and more preferably an aromatic diol.

The dial may be used in combination with a tri- or higher-hydric alcohol having a crosslinked structure or branched structure as the polyhydric alcohol. Examples of the tri- or higher-hydric alcohol include glycerin, trimethylolpropane, and pentaerythritol.

The polyhydric alcohols may be used alone or in combination of two or more.

The glass transition temperature (Tg) of the amorphous polyester resin is preferably 50° C. or more and 80° C. or less and more preferably 50° C. or more and 65° C. or less.

The glass transition temperature can be determined from a DSC curve obtained by differential scanning calorimetry (DSC). More specifically, the glass transition temperature can be determined by "Extrapolation Glass Transition Starting Temperature" described in Determination of Glass Transition Temperature of JIS K7121-1987 "Testing methods for transition temperatures of plastics".

The weight-average molecular weight (Mw) of the amorphous polyester resin is preferably 5,000 or more and 1,000,000 or less and more preferably 7,000 or more and 500,000 or less.

The number-average molecular weight (Mn) of the amorphous polyester resin is preferably 2,000 or more and 100,000 or less.

The molecular weight distribution Mw/Mn of the amorphous polyester resin is preferably 1.5 or more and 100 or less and more preferably 2 or more and 60 or less.

The weight-average molecular weight and number-average molecular weight are measured by gel permeation chromatography (GPC). The GPC molecular weight measurement is performed by using GPC·HLC-8120GPC manufactured by Tosoh Corporation as a measurement apparatus, TSK gel Super HM-M (15 cm) manufacture by Tosoh Corporation as a column, and THF as a solvent. The weight-average molecular weight and number-average molecular weight are calculated from the measurement results by using a molecular weight calibration curve formed by using monodisperse polystyrene standard samples.

The amorphous polyester resin can be produced by a known production method. Specifically, the amorphous polyester resin can be produced by, for example, a method of reaction at a polymerization temperature of 180° C. or more and 230° C. or less, if required, in a reaction system under reduced pressure while the water and alcohol produced in the condensation is removed.

When a monomer used as a raw material is insoluble or incompatible at the reaction temperature, the monomer may be dissolved by adding a solvent having a high boiling point as a solubilizer. In this case, polymerization reaction is performed while the solubilizer is distilled off. When a monomer with low compatibility is present in copolymerization reaction, the monomer with low compatibility may be previously condensed with an acid or alcohol to be polycondensed with the monomer and then polycondensed with a main component.

Crystalline Polyester Resin

The crystalline polyester resin is, for example, a condensation polymer of a polyhydric carboxylic acid and a polyhydric alcohol. The crystalline polyester resin used may be a commercial product or a synthesized product.

In order to easily form a crystal structure, the crystalline polyester resin is preferably a condensation polymer using a polymerizable monomer having a linear aliphatic group rather than a polymerizable monomer having an aromatic group.

Examples of the polyhydric carboxylic acid include aliphatic dicarboxylic acids (for example, oxalic acid, succinic acid, glutaric acid, adipic acid, suberic acid, azelaic acid, sebacic acid, 1,9-nonanedicarbocylic acid, 1,10-decanedicarboxylic acid, 1,12-dodecanedicarboxylic acid, and the like), aromatic dicarboxylic acids (for example, dibasic acids such as phthalic acid, isophthalic acid, terephthalic acid, naphthalene-2,6-dicarboxylic acid, and the like), and anhydrides or lower (for example, 1 or more and 5 or less carbon atoms) alkyl esters thereof.

The dicarboxylic acid may be used in combination with a tri- or higher-hydric carboxylic acid having a crosslinked structure or branched structure as the polyhydric carboxylic acid. Examples of the trihydric carboxylic acid include aromatic carboxylic acids (for example, 1,2,3-benzene tricarboxylic acid, 1,2,4-benzene tricarboxylic acid, 1,2,4-naphthalene tricarboxylic acid, and the like, and anhydrides or lower (for example, 1 or more and 5 or less carbon atoms) alkyl esters thereof.

Any one of these dicarboxylic acids may be used in combination with a dicarboxylic acid having a sulfonic acid group or a dicarboxylic acid having an ethylenically double bond as the polyhydric carboxylic acid.

The polyhydric carboxylic acids may be used alone or in combination of two or more.

Examples of the polyhydric alcohol include aliphatic diols (for example, linear aliphatic diols each having a main chain part having 7 or more and 20 or less carbon atoms). Examples of the aliphatic dials include ethylene glycol, 1,3-propanediol, 1,4-butanediol, 1,5-pentanediol, 1,6-hexanediol, 1,7-heptanediol, 1,8-octanediol, 1,9-nonanediol, 1,10-decanediol, and the like. Among these, the aliphatic diol is preferably 1,8-octanediol, 1,9-nonanediol, or 1,10-decanediol.

The diol may be used in combination with a tri- or higher-hydric alcohol having a crosslinked structure or branched structure as the polyhydric alcohol. Examples of the tri- or higher-hydric alcohol include glycerin, trimethylolethane, trimethylolpropane, pentaerythritol, and the like.

The polyhydric alcohols may be used alone or in combination of two or more.

The content of the aliphatic diol as the polyhydric alcohol is preferably 80 mol % or more and more preferably 90 mol % or more.

From the viewpoint of achieving high dispersibility in the toner particles (in the amorphous polyester resin) and easily enhancing the function of suppressing light transmission of the white image, the crystalline polyester resin is preferably a polymer of a monomer group containing at least one selected from polyhydric carboxylic acids (acid monomers) having 2 or more and 12 or less (more preferably 4 or more and 12 or less) carbon atoms and at least one selected from polyhydric alcohols (alcohol monomers) having 2 or more and 10 or less (more preferably 4 or more and 10 or less) carbon atoms.

Examples of a preferred combination include the following combinations.

Polymer containing, as polymerization components, a polyhydric carboxylic acid (dodecanedioic acid) having 12 carbon atoms and a polyhydric alcohol (nonanediol) having 9 carbon atoms Polymer containing, as polymerization components, a polyhydric carboxylic acid (octanedioic acid) having 8 carbon atoms and a polyhydric alcohol (hexanediol) having 6 carbon atoms Polymer containing, as polymerization components, a polyhydric carboxylic acid (dodecanedioic acid) having 12 carbon atoms and a polyhydric alcohol (ethanediol) having 2 carbon atoms Polymer containing, as polymerization components, a polyhydric carboxylic acid (decanedioic acid) having 10 carbon atoms and a polyhydric alcohol (hexanediol) having 6 carbon atoms Polymer containing, as polymerization components, a polyhydric carboxylic acid (octanedioic acid) having 8 carbon atoms and a polyhydric alcohol (butanediol) having 4 carbon atoms Polymer containing, as polymerization components, a polyhydric carboxylic acid (octanedioic acid) having 8 carbon atoms and a polyhydric alcohol (ethanediol) having 2 carbon atoms The melting temperature of the crystalline polyester resin is preferably 50° C. or more and 100° C. or less, more preferably 55° C. or more and 90° C. or less, and still more preferably 60° C. or more and 85° C. or less.

The melting temperature can be determined from a DSC curve obtained by differential scanning calorimetry (DSC) according to "Melting Peak Temperature" described in Determination of Melting Temperature of JIS K7121-1987 "Testing methods for transition temperatures of plastics".

The weight-average molecular weight (Mw) of the crystalline polyester resin is preferably 6,000 or more and 35,000 or less.

For example, like the amorphous polyester resin, the crystalline polyester resin can be produced by a known method.

The content of the binder resin is, for example, preferably 40% by mass or more and 95% by mass or less, more preferably 50% by mass or more and 90% by mass or less, and still more preferably 60% by mass or more and 85% by mass or less relative to the whole toner particles.

Contents of Crystalline and Amorphous Polyester Resins

Also, the content of the crystalline polyester resin is preferably 5% by mass or more and 25% by mass or less, more preferably 7% by mass or more and 23% by mass or less, and still more preferably 10% by mass or more and 21% by mass or less relative to the whole toner particles.

When the content of the crystalline polyester resin is 5% by mass or more, the polyester resin can easily exhibit the function of suppressing light transmission. On the other hand, when the content of the crystalline polyester resin is 25% by mass or less, dispersibility of the crystalline polyester resin in the amorphous polyester resin can be easily enhanced, thereby easily suppressing the light transmission of the white image.

In addition, the content of the amorphous polyester resin is preferably 20% by mass or more and 80% by mass or less, more preferably 25% by mass or more and 75% by mass or less, and still more preferably 30% by mass or more and 70% by mass or less relative to the whole toner particles.

When the content of the amorphous polyester resin is 80% by mass or less, the crystalline polyester resin can easily exhibit the function of suppressing light transmission. On the other hand, when the content of the amorphous polyester resin is 20% by mass or more, dispersibility of the crystalline polyester resin in the amorphous polyester resin can be easily enhanced, thereby easily suppressing the light transmission of the white image.

Further, from the viewpoint of achieving high dispersibility of the crystalline polyester resin in the toner particles (in the amorphous polyester resin) and easily enhancing the function of suppressing light transmission of the white image, the ratio (Cr/Am) of the content [Cr] of the crystalline polyester resin to the content [Am] of the amorphous polyester resin in the toner particles is preferably 0.15 or more and 0.90 or less, more preferably 0.25 or more and 0.80 or less, and still more preferably 0.30 or more and 0.70 or less.

SP Values of Crystalline and Amorphous Polyester Resins

From the viewpoint of achieving high dispersibility of the crystalline polyester resin in the toner particles (in the amorphous polyester resin) and easily enhancing the function of suppressing light transmission of the white image, a difference in SP value between the crystalline polyester resin and the amorphous polyester resin is preferably 0.8 or more and 1.1 or less and more preferably 0.9 or more and 1.0 or less.

From the viewpoint of controlling the difference in SP value within the range described above, the SP value of the crystalline polyester resin is preferably 8.5 or more and 10.0 or less, more preferably 8.7 or more and 9.8 or less, and still more preferably 8.9 or more and 9.5 or less.

On the other hand, the SP value of the amorphous polyester resin is preferably 9.5 or more and 10.5 or less and more preferably 9.7 or more and 10.3 or less.

The SP value of each of the crystalline polyester resin and the amorphous polyester resin can be adjusted by selecting the polymerization components (monomers) used for synthesizing each of the resins.

Here, a method for calculating the SP value of each of the crystalline polyester resin and the amorphous polyester resin is described.

The solubility parameter SP value (δ) can be determined by a method described below, but the method is not limited to this. The SP value is defined as a function of cohesive energy density by the following formula.

$$\delta=(\Delta E/V)^{1/2}$$

ΔE: intermolecular cohesive energy (evaporation heat)

V: total volume of mixed liquid

ΔE/V: cohesive energy density

In addition, when a resin has a known monomer composition, the SP value can be calculated by the method of Fedor et al. (method described in Polym. Eng. Sci., 14[2] (1974)).

$$SP \text{ value}=(\Sigma\Delta ei/\ominus\Delta vi)^{1/2}$$

Δei; evaporation energy of atom or atomic group

Δvi: molar volume of atom or atomic group

In the specification of the present invention, a value determined by calculation from a monomer composition is used as the SP value.

Coloring Agent (White Pigment)

The white toner according to the exemplary embodiment contains a coloring agent (white pigment) in the core portions of the toner particles.

Examples of the white pigment include titanium oxide (TiO2), zinc oxide (ZnO, zinc flower), calcium carbonate (CaCO3), basic lead carbonate (2PbCO3Pb(OH)2, lead white), zinc sulfide-barium sulfate mixture (lithopone), zinc sulfide (ZnS), silicon dioxide (SiO2, silica), aluminum oxide (Al2O3, alumina), and the like. Among these, titanium oxide (TiO2) is preferred.

The white pigments may be used alone or in combination of two or more.

The white pigment may be surface-treated or used in combination with a dispersant.

The average primary particle diameter of the white pigment is preferably 150 nm or more and 400 nm or less.

The content of the white pigment relative to the whole toner particles in the white toner is preferably 15% by mass or more and 45% by mass or less, more preferably 17% by mass or more and 43% by mass or less, and still more preferably 20% by mass or more and 40% by mass or less.

When the content of the white pigment is 15% by mass or more, the hiding properties can be easily enhanced. While when the content of the white pigment is 45% by mass or less, a decrease in hiding properties due to transfer defect can be advantageously easily suppressed.

Mold Release Agent

Examples of the mold release went include hydrocarbon-based wax; natural wax such as carnauba wax, rice bran wax, candelilla wax, and the like; synthetic or mineral-based/petroleum wax such as montan wax and the like; ester-based wax such as fatty acid esters, montanic acid esters, and the like; and the like. The mold release agent is not limited to these.

The melting temperature of the mold release agent is preferably 50° C. or more and 110° C. or less and more preferably 60° C. or more and 100° C. or less.

The melting temperature of the mold release agent can be determined from a DSC curve obtained by differential scanning calorimetry (DSC) according to "Melting Peak Temperature" described in Determination of Melting Temperature of JIS K7121-1987 "Testing methods for transition temperatures of plastics".

The content of the mold release agent is, for example, preferably 1% by mass or more and 20% by mass or less and more preferably 5% by mass or more and 15% by mass or less relative to the whole toner particles.

Other Additives

Examples of other additives include known additives such as a magnetic material, a charge control agent, an inorganic powder, and the like. These additives are contained as internal additives in the toner particles.

[Characteristics of Toner Particle]

The toner particles may be toner particles with a single-layer structure or toner particles with a so-called core-shell structure configurated by a core part (core particle) and a coating layer (shell layer) which coats the core part.

The toner particles with a core-shell structure are configurated by, for example, a core part containing a binder resin and, if required, other additives such as a coloring agent, a mold release agent, etc., and a coating layer containing the binder resin.

Further, in the case of the toner particles with the core-shell structure, the binder resin contained in the coating layer is more preferably the amorphous polyester resin.

The volume-average particle diameter (D50v) of the toner particles is preferably 2 μm or more and 10 μm or less and more preferably 4 μm or more and 8 μm or less.

The various average particle diameters and various particle size distribution indexes of the toner particles are measured by using Coulter Multisizer II (manufactured by Beckman Coulter Inc.) and an electrolytic solution ISOTON-II (manufactured by Beckman Coulter Inc.).

In the measurement, 0.5 mg or more and 50 mg or less of a measurement sample is added to 2 ml of a 5% aqueous solution of a surfactant (preferably sodium alkylbenzene sulfonate) serving as a dispersant. The resultant mixture is added to 100 ml or more and 150 ml or less of the electrolytic solution.

The electrolytic solution in which the sample has been suspended is dispersed for 1 minute by using an ultrasonic disperser, and a particle size distribution of particles having a particle diameter within a range of 2 μm or more and 60 μm or less is measured by using Coulter Multisizer II with an aperture having an aperture diameter of 100 μm. The number of particles sampled is 50,000.

Each of volume-based and number-based cumulative distributions is formed from the smaller diameter side for particle size ranges (channels) divided based on the measured particle size distribution. In the particle size distributions, the cumulative 16% particle diameters are defined as the volume particle diameter D16v and number particle diameter D16p, the cumulative 50% particle diameters are defined as the volume-average particle diameter D50v and cumulative number-average particle diameter D50p, and the cumulative 84% particle diameters are defined as the volume particle diameter D84v and number particle diameter D84p.

By using these particle diameters, the volume particle size distribution index (GSDv) and the number particle size distribution index (GSDp) are calculated as $(D84v/D16v)^{1/2}$ and $(D84p/D16p)^{1/2}$, respectively.

The average roundness of the toner particles is preferably 0.94 or more and 1.00 or less and more preferably 0.95 or more and 0.98 or less.

The average roundness of the toner particles is determined by (equivalent circle circumference length)/(circumference length) [(circumference length of a circle having the same projection area as a particle image)/(circumference length of particle projection image)]. Specifically, the average roundness is a value measured by the following method.

First, the toner particles used as a measurement object are collected by suction to form a flat flow, a particle image is captured as a still image by instantaneous strobe light emission, and the average roundness is determined by image analysis of the particle image by using a flow particle image analyzer (FPIA-3000 manufactured by Sysmex Corporation). The number of particles sampled for determining the average roundness is 3,500.

When the toner contains an external additive, the toner (developer) as a measurement object is dispersed in water containing a surfactant, and then the external additive is removed by ultrasonic treatment to produce the toner particles.

[External Additive]

The external additive is, for example, inorganic particles. Examples of the inorganic particles include particles of $SiO_2$, $TiO_2$, $Al_2O_3$, CuO, ZnO, $SnO_2$, $CeO_2$, $Fe_2O_3$, MgO, BaO, CaO, $K_2O$, $Na_2O$, $ZrO_2$, $CaO.SiO_2$, $K_2O.(TiO_2)_n$, $Al_2O_3.2SiO_2$, $CaCO_3$, $MgCO_3$, $BaSO_4$, $MgSO_4$, and the like.

The surfaces of inorganic particles used as the external additive may be hydrophobically treated. The inorganic particles are hydrophobically treated by, for example, dipping in a hydrophobic treatment agent. Examples of the hydrophobic treatment agent include, but are not limited to, a silane coupling agent, silicone oil, titanate-based coupling agent, an aluminum-based coupling agent, and the like. These may be used alone or in combination of two or more.

The amount of the hydrophobic treatment agent is, for example, generally 1 part by mass or more and 10 parts by mass or less relative to 100 parts by mass of inorganic particles.

Other examples of the external additive include resin particles (for example, resin particles of polystyrene, polymethyl methacrylate (PMMA), melamine resin, and the like), cleaning activators (for example, a higher fatty acid metal salt such as zinc stearate, and fluorine-based polymer particles), and the like.

The amount of the external additive externally added is, for example, preferably 0.01% by mass or more and 5% by mass or less and more preferably 0.01% by mass or more and 2.0% by mass or less relative to the toner particles.

[Method for Producing Toner]

Next, a method for producing the toner according to the exemplary embodiment is described.

The toner according to the exemplary embodiment is produced by producing the toner particles and then externally adding the external additive to the toner particles.

The toner particles may be produced by a dry method (for example, a kneading-grinding method or the like) or a wet method (for example, an aggregation coalescence method, a suspension polymerization method, a dissolution suspension method, or the like) as long as the configuration of the white toner is satisfied. These methods are not particularly limited, and a known method is used.

Among these, the aggregation coalescence method is preferred for producing the toner particles.

Specifically, for example, when the toner particles are produced by the aggregation coalescence method, the toner particles are produced as follows.

A resin particle dispersion in which resin particles used as the binder resin are dispersed is prepared (preparation of a resin particle dispersion). The resin particles (if required, other particles) are aggregated in the resin particle dispersion (if required, a dispersion mixture with another particle dispersion) to form aggregated particles (formation of aggregated particles). The aggregated particles are fused and coalesced by heating the aggregated particle dispersion in which the aggregated particles are dispersed, thereby forming the toner particles (fusion/coalescence).

Each of the processes is described in detail below.

In the description below, the method for producing the toner particles containing the coloring agent and the mold release agent is described, but the coloring agent and the mold release agent are used according to demand. Of course, other additives other than the coloring agent and the mold release agent may be used.

Preparation of Resin Particle Dispersion

In addition to the resin particle dispersion in which the resin particles used as the binder resin are dispersed, there are prepared a coloring agent particle dispersion in which the coloring agent particles are dispersed, and a mold release agent particle dispersion in which the mold release agent particles are dispersed. In addition, a dispersion of the crystalline polyester resin and a dispersion of the amorphous polyester resin may be separately prepared or prepared as a mixed dispersion, but are preferably prepared as separated dispersions.

The resin particle dispersion is prepared by, for example, dispersing the resin particles in a dispersion medium with a surfactant.

The dispersion medium used in the resin particle dispersion is, for example, an aqueous medium.

Examples of the aqueous medium include water such as distilled water, ion exchange water, and the like, alcohols, and the like. These may be used alone or in combination of two or more.

Examples of the surfactant include sulfate ester salt-based, sulfonic acid salt-based, phosphate ester-based, and soap-based anionic surfactants and the like: amine salt-type and quaternary ammonium salt-type cationic surfactants and the like; polyethylene glycol-based, alkylphenol ethylene oxide adduct-based, and polyhydric alcohol-based nonionic surfactants and the like; and the like. Among these, an anionic surfactant or cationic surfactant is particularly used. A nonionic surfactant may be used in combination with the anionic surfactant or cationic surfactant.

These surfactants may be used alone or in combination of two or more.

A method for dispersing the resin particles in the dispersion medium of the resin particle dispersion is, for example, a general dispersion method using a rotary-shear homogenizer, a ball mill having media, a sand mill, a dyno mill, or the like. The resin particles may be dispersed in the resin particle dispersion by a phase inversion emulsion method according to the type of the resin particles.

The phase inversion emulsion method is a method including dissolving a resin to be dispersed in a hydrophobic organic solvent which can dissolve the resin, neutralizing an organic continuous phase (O phase) by adding a base thereto, and then performing resin inversion (so-called phase inversion) from W/O to O/W by pouring a water medium (W phase) to form a discontinuous phase, thereby dispersing the resin in the form of particles in the water medium.

The volume-average particle diameter of the resin particles dispersed in the resin particle dispersion is, for example, preferably 0.01 μm or more and 1 μm or less, more preferably 0.08 μm or more and 0.8 μm or less, and still more preferably 0.1 μm or more and 0.6 μm or less.

The volume-average particle diameter of the resin particles is determined by using a particle size distribution obtained by measurement using a laser diffraction particle size distribution analyzer (for example, LA-700 manufactured by HORIBA, Ltd.). A volume-based cumulative distribution is formed from the smaller particle diameter side for the divided particle size ranges (channels), and the particle diameter at 50% of the volume of the whole particles is measured as the volume-average particle diameter D50v. The volume-average particle diameter of particles in any one of the other dispersions is measured by the same method.

The content of the resin particles contained in the resin particle dispersion is, for example, preferably 5% by mass or more and 50% by mass or less and more preferably 10% by mass or more and 40% by mass or less.

The domain diameter of the crystalline polyester resin in the toner particles can be controlled by adjusting the particle diameter of the resin particles in the crystalline polyester resin particle dispersion prepared in the preparation of the resin particle dispersion.

The volume-average particle diameter of the resin particles in the crystalline polyester resin particle dispersion is preferably 50 nm or more and 400 nm or less and more preferably 100 nm or more and 300 nm or less.

When the volume-average particle diameter is D50v of the crystalline polyester resin particles is 50 nm or more, the crystalline polyester resin in the toner particles has a proper domain diameter, and thus light transparency can be decreased, and the hiding properties can be easily enhanced. When the volume-average particle diameter D50v of the crystalline polyester resin particles is within the range described above, the uneven distribution of the crystalline polyester resin between toner particles is suppressed, dispersion in the toner particles is improved, and the hiding properties can be easily improved.

The coloring agent particle dispersion and the mold release agent particle dispersion are prepared by the same method as for the resin particle dispersion. That is, the volume-average particle diameter, dispersion medium, dispersion method, and content of the particles in the resin particle dispersion are true for the coloring agent particles dispersed in the coloring agent particle dispersion and the mold release agent particles dispersed in the mold release agent particle dispersion, Formation of Aggregated Particles Next, the resin particle dispersion, the coloring agent particle dispersion, and the mold release agent particle dispersion are mixed together. Then, the resin particles, the coloring agent particles, and the mold release agent particles are hetero-aggregated in the resultant mixed dispersion to form the aggregated particles having a diameter close to the diameter of the intended toner particles.

Specifically, an aggregating agent is added to the mixed dispersion and, at the same time, pH of the mixed dispersion is adjusted to an acidic value (for example, pH 2 or more and 5 or less) and, if required, a dispersion stabilizer is added. Then, the particles dispersed in the mixed dispersion are aggregated by heating the resultant mixture to a temperature (specifically, for example, (glass transition temperature of resin particles −30° C.) or more and (glass transition temperature of resin particles −10° C.) or less, which is close to the glass transition temperature of the resin particles, thereby forming the aggregated particles.

In forming the aggregated particles, the aggregating agent may be added at room temperature (for example, 25° C.) under stirring of the mixed dispersion by using a rotary shear homogenizer, then pH of the mixed dispersion may be adjusted to an acidic value (for example, pH 2 or more and 5 or less), and, if required, a dispersion stabilizer may be added before heating.

Examples of the aggregating agent include a surfactant with the polarity opposite to that of the surfactant contained as the dispersant in the mixed dispersion, inorganic metal salts, and di- or higher-valent metal complexes. When a metal complex is used as the aggregating agent, the amount of the surfactant used is decreased, and charging characteristics are improved.

If required, the aggregating agent may be used in combination with an additive which forms a complex or similar bond with the metal ion of the aggregating agent. A chelating agent is preferably used as the additive.

Examples of the inorganic metal salts include metal salts such as calcium chloride, calcium nitrate, barium chloride, magnesium chloride, zinc chloride, aluminum chloride, aluminum sulfate, and the like; inorganic metal salt polymers such as aluminum polychloride, aluminum polyhydroxide, calcium polysulfide, and the like.

The chelating agent used may be a water-soluble chelating agent. Examples of the chelating agent include oxycarboxylic acids such as tartaric acid, citric acid, gluconic acid, and the like; imino-diacetic acid (IDA), nitrilotriacetic acid (NTA), ethylenediaminetetraacetic acid (EDTA), and the like; and the like.

The amount of the chelating agent added is, for example, preferably 0.01 parts by mass or more and 5.0 parts by mass or less and more preferably 0.1 parts by mass or more and 3.0 parts by mass or less relative to 100 parts by mass of the resin particles.

Fusion-Coalescence

Next, the aggregated particles are fused and coalesced by heating the aggregated particle dispersion in which the aggregated particles are dispersed to, for example, a temperature equal to or higher than the glass transition temperature of the resin particles (for example, 10° C. to 30° C. higher than the glass transition temperature of the resin particles), thereby forming the toner particles.

The toner particles are produced through the process described above.

The toner particles may be produced as follows. After the preparation of the aggregated particle dispersion in which the aggregated particles are dispersed, the aggregated particle dispersion is further mixed with the resin particle dispersion in which the resin particles are dispersed, and second aggregated particles are formed by aggregation so that the resin particles further adhere to the surfaces of the aggregated particles. Then, the second aggregated particles are fused and coalesced by heating the second aggregated particle dispersion, in which the second aggregated particles are dispersed, to form toner particles with a core-shell structure.

The toner particles may be produced by an aggregation coalescence method described below. The aggregation coalescence method described below can easily produce the toner particles containing the crystalline polyester resin with high dispersibility in the amorphous polyester resin. As a result, the toner satisfying the physical properties such as the loss tangent tan δ and storage modulus G', etc. described above can be easily produced.

That is, the dispersibility of the crystalline polyester resin can be controlled to realize proper dispersibility by adjusting, in forming the aggregated particles, the concentration or the like of each of the crystalline polyester resin particle dispersion and the amorphous polyester resin particle dispersion.

Specifically, in forming the aggregated particles (forming the aggregated particles serving as a core in the case of the aggregated particles having the core-shell structure), the toner particles containing the crystalline polyester resin with high dispersibility can be easily produced by controlling variation in the concentration of the crystalline polyester resin particles in the mixed dispersion, that is, maintaining the concentration closer to a constant state. Thus, the toner satisfying the physical properties such as the loss tangent tan δ and storage modulus G', etc. described above can be easily produced.

Specifically, the toner particles are produced as follows.

Each of the dispersions is prepared (preparation of each of the dispersions). A first resin particle dispersion in which first resin particles as the binder resin are dispersed, and a mixed dispersion in which particles of the coloring agent (white pigment) (also referred to as the "coloring agent particles" hereinafter) and particles of the mold release agent (also referred to as the "mold release agent particles" hereinafter) are dispersed are mixed, and the particles are aggregated in the resultant dispersion to form first aggregated particles (formation of the first aggregated particles).

After the preparation of the first aggregated particle dispersion in which the first aggregated particles are dispersed, a mixed dispersion in which second resin particles as the crystalline resin and third resin particles as the binder resin are dispersed is added to the first aggregated particle dispersion to further aggregate the second resin particles and the third resin particles on the surfaces of the first aggregated particles, thereby forming second aggregated particles (formation of the second aggregated particles).

After the preparation of the second aggregated particle dispersion in which the second aggregated particles are dispersed, a fourth resin particle dispersion in which fourth resin particles as the binder resin are dispersed is further mixed to further aggregate the fourth resin particles on the surfaces of the second aggregated particles, thereby forming third aggregated particles (formation of the third aggregated particles).

The third aggregated particle dispersion in which the third aggregated particles are dispersed is heated to fuse and coalesce the third aggregated particles, thereby forming the toner particles (fusion-coalescence).

The method for producing the toner particles is not limited to the above. The toner particles may be formed by, for example, mixing the resin particle dispersion, the mold release agent particle dispersion, and the coloring agent particle dispersion; aggregating the particles in the resultant mixed dispersion; next, during the aggregation, promoting aggregation of the particles by adding the resin particle dispersion to the mixed dispersion to form aggregated particles; and then fusing and coalescing the aggregated particles.

Each of the processes is described in detail below.

Preparation of Each Dispersion

First, each of the dispersions used in the aggregation coalescence method is prepared. Specifically, there are prepared the first resin particle dispersion in which the first resin particles as the binder resin are dispersed, the second resin particle dispersion in which the second resin particles as the crystalline resin are dispersed, the third resin particle dispersion in which the third resin particles as the binder resin are dispersed, the fourth resin particle dispersion in which the fourth resin particles as the binder resin are dispersed, the coloring agent particle dispersion in which the coloring agent particles (white pigment particles) are dispersed, and the mold release agent particle dispersion in which the mold release agent particles are dispersed.

In the preparation of each of the dispersion, the first resin particles, the second resin particles, the third resin particles, and the fourth resin particles are referred to as the "resin particles" in the description below.

The resin particle dispersion is prepared by, for example, dispersing the resin particles in a dispersion medium with a surfactant.

The dispersion medium used in the resin particle dispersion is, for example, an aqueous medium.

Examples of the aqueous medium include water such as distilled water, ion exchange water, and the like, alcohols, and the like. These may be used alone or in combination of two or more.

Examples of the surfactant include sulfate ester salt-based, sulfonic acid salt-based, phosphate ester-based, and soap-based anionic surfactants and the like: amine salt-type and quaternary ammonium salt-type cationic surfactants and the like; polyethylene glycol-based, alkylphenol ethylene oxide adduct-based, and polyhydric alcohol-based nonionic surfactants and the like; and the like. Among these, an anionic surfactant or cationic surfactant is particularly used. A nonionic surfactant may be used in combination with the anionic surfactant or cationic surfactant.

These surfactants may be used alone or in combination of two or more.

A method for dispersing the resin particles in the dispersion medium of the resin particle dispersion is, for example, a general dispersion method using a rotary-shear homogenizer, a ball mill having media, a sand mill, a dyne mill, or the like. The resin particles may be dispersed in the resin particle dispersion by a phase inversion emulsion method according to the type of the resin particles.

The phase inversion emulsion method is a method including dissolving a resin to be dispersed in a hydrophobic organic solvent which can dissolve the resin, neutralizing an organic continuous phase (O phase) by adding a base thereto, and then performing resin inversion (so-called phase inversion) from W/O to O/W by pouring a water medium (W phase) to form a discontinuous phase, thereby dispersing the resin in the form of particles in the water medium.

The volume-average particle diameter of the resin particles dispersed in the resin particle dispersion is, for example, preferably 0.01 μm or more and 1 μm or less, more preferably 0.08 μm or more and 0.8 μm or less, and still more preferably 0.1 μm or more and 0.6 μm or less.

The content of the resin particles contained in the resin particle dispersion is preferably 5% by mass or more and 50% by mass or less and more preferably 10% by mass or more and 40% by mass or less.

The coloring agent particle dispersion and the mold release agent particle dispersion are prepared by the same method as for the resin particle dispersion. That is, the volume-average particle diameter, dispersion medium, dispersion method, and content of the particles in the resin particle dispersion are true for the coloring agent particles dispersed in the coloring agent particle dispersion and the mold release agent particles dispersed in the mold release agent particle dispersion.

Formation of First Aggregated Particles

Next, the first resin particle dispersion, the coloring agent particle dispersion, and the mold release agent particle dispersion are mixed.

Then, the first resin particles, the coloring agent particles, and the mold release agent particles are hetero-aggregated in the resultant mixed dispersion to form the first aggregated particles containing the first rein particles, the coloring agent particles, and the mold release agent particles.

Specifically, the aggregating agent is added to the mixed dispersion and, at the same time, pH of the mixed dispersion is adjusted to an acidic value (for example, pH 2 or more and 5 or less) and, if required, a dispersion stabilizer is added. Then, the particles dispersed in the mixed dispersion are aggregated by heating the resultant mixture to a temperature (specifically, for example, (glass transition temperature of first resin particles −30° C.) or more and (glass transition temperature of first resin particles −10° C.) or less, which is close to the glass transition temperature of the first resin particles, thereby forming the first aggregated particles.

In forming the first aggregated particles, the aggregating agent may be added at room temperature (for example, 25°

C.) under stirring of the mixed dispersion by using a rotary shear homogenizer, then pH of the mixed dispersion may be adjusted to an acidic value (for example, pH 2 or more and 5 or less), and, if required, a dispersion stabilizer may be added before heating.

Examples of the aggregating agent include a surfactant with the polarity opposite to that of the surfactant contained as a dispersant in the mixed dispersion, inorganic metal salts, and di- or higher-valent metal complexes. When a metal complex is used as the aggregating agent, the amount of the aggregating agent used is decreased, and charging characteristics are improved.

The aggregating agent may be used in combination with an additive which forms a complex or similar bond with the metal ion of the aggregating agent. A chelating agent is preferably used as the additive.

Examples of the inorganic metal salts include metal salts such as calcium chloride, calcium nitrate, barium chloride, magnesium chloride, zinc chloride, aluminum chloride, aluminum sulfate, and the like; inorganic metal salt polymers such as aluminum polychloride, aluminum polyhydroxide, calcium polysulfide, and the like.

The chelating agent used may be a water-soluble chelating agent. Examples of the chelating agent include oxycarboxylic acids such as tartar acid, citric acid, gluconic acid, and the like; imino-diacetic acid (IDA), nitrilotriacetic acid (NTA), ethylenediaminetetraacetic (EDTA), and the like; and the like.

The amount of the chelating agent added is, for example, preferably 0.01 parts by mass or more and 5.0 parts by mass or less and more preferably 0.1 parts by mass or more and 3.0 parts by mass or less relative to 100 parts by mass of the first resin particles.

Formation of Second Aggregated Particles

Next, after the preparation of the first aggregated particle dispersion in which the first aggregated particles are dispersed, the mixed dispersion in which the second resin particles (crystalline resin) and the third resin particles (binder resin) are dispersed is added to the first aggregated particle dispersion.

The third resin particles may be the same as or different from the first resin particles.

Then, the second resin particles and the third resin particles are aggregated on the surfaces of the first aggregated particles in the dispersion in which the first aggregated particles, the second resin particles, and the third resin particles are dispersed. Specifically, for example, when the first aggregated particles reach the target diameter in forming the first aggregated particles, the mixed dispersion in which the second resin particles and the third resin particles are dispersed is added to the first aggregated particle dispersion, and the resultant dispersion is heated to a temperature equal or lower than the glass transition temperature of the third resin (binder resin) particles.

The aggregated particles are formed as described above, in which the second resin particles and third resin particles adhere to the surfaces of the first aggregated particles. That is, the second aggregated particles are formed, in which aggregates of the second resin particles and third resin particles adhere to the surfaces of the first aggregated particles. In this case, the mixed dispersion in which the second resin particles and the third resin particles are dispersed is sequentially added to the first aggregated particle dispersion, and thus the aggregates of the second resin particles and the third resin particles adhere to the surfaces of the first aggregated particles so that the concentration (presence ratio) of the crystalline resin particles gradually decreases outward in the particle diameter direction.

In this case, a power feed addition method may be used as a method for adding the mixed dispersion. By using the power feed addition method, it is possible to add the mixed dispersion to the first aggregated particle dispersion while adjusting the concentration of the crystalline resin particles in the mixed dispersion.

The method for adding the mixed dispersion by using the power feed addition method is described below with reference to the drawing.

Figure 3:
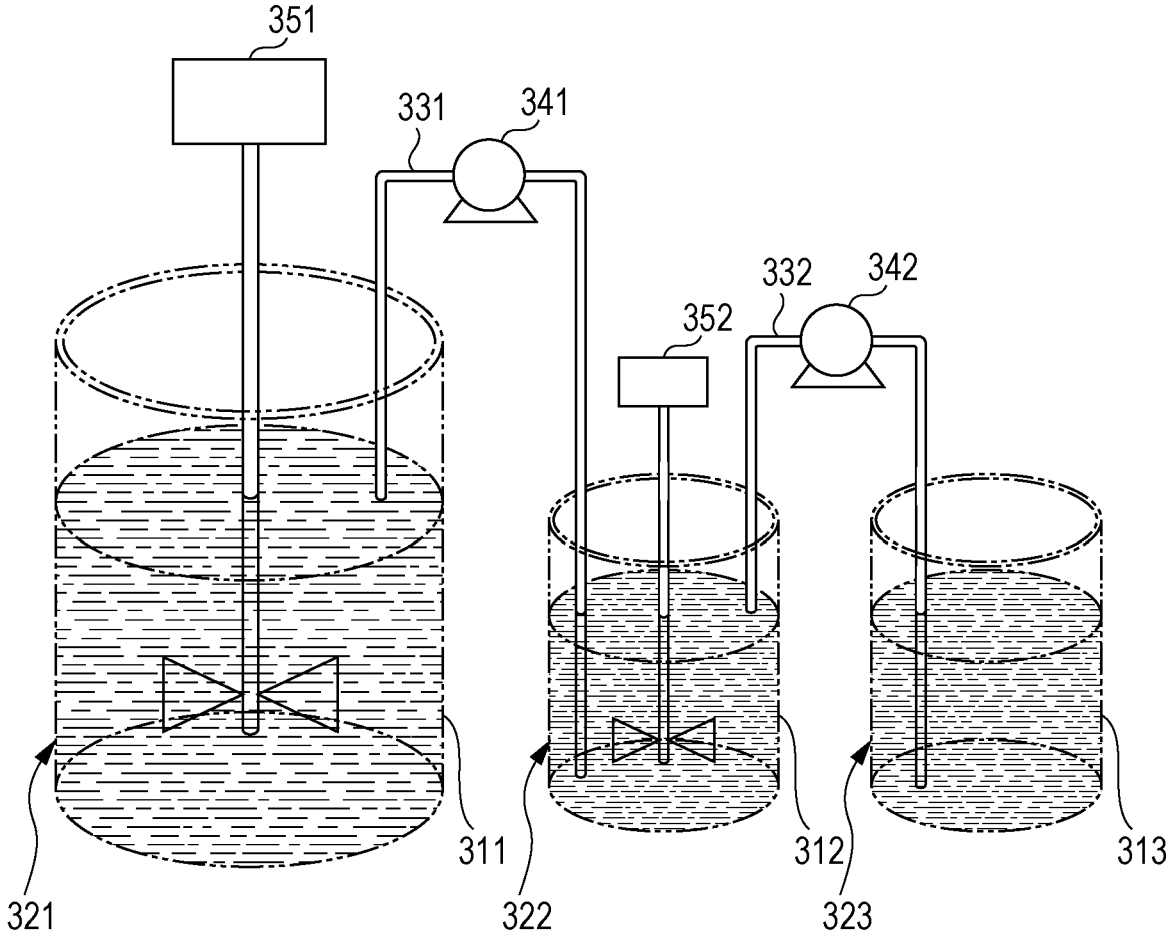
FIG. 3 is a schematic drawing for illustrating a power feed addition method.

FIG. 3 shows an apparatus used in the power feed addition method. In FIG. 3, reference numeral 311 denotes the first aggregated particle dispersion, reference numeral 312 denotes the second resin (crystalline resin) particle dispersion, and reference numeral 313 denotes the third resin (binder resin) particle dispersion.

The apparatus shown in FIG. 3 includes a first housing tank 321 which houses the first aggregated particle dispersion containing the first aggregated particles dispersed therein, a second housing tank 322 which houses the second resin particle dispersion containing the second resin particles (crystalline resin) dispersed therein, and a third housing tank 323 which houses the third resin particle dispersion containing the third resin (binder resin) particles dispersed therein.

The first housing tank 321 and the second housing tank 322 are connected to each other through a first feed pipe 331. A first feed pump 341 is disposed in the course of the first feed pipe 331. By driving the first feed pump 341, the dispersion housed in the second housing tank 322 is fed to the dispersion housed in the first housing tank 321 through the first feed pipe 331.

In addition, a first stirring device 351 is disposed in the first housing tank 321. When the dispersion housed in the second housing tank 322 is fed to the dispersion housed in the first housing tank 321, the dispersions are stirred and mixed in the first housing tank 321 by driving the first stirring device 351.

The second housing tank 322 and the third housing tank 323 are connected to each other through a second feed pipe 332. A second feed pump 342 is disposed in the course of the second feed pipe 332. By driving the second feed pump 342, the dispersion housed in the third housing tank 323 is fed to the dispersion housed in the second housing tank 322 through the second feed pipe 332.

In addition, a second stirring device 352 is disposed in the second housing tank 322. When the dispersion housed in the third housing tank 323 is fed to the dispersion housed in the second housing tank 322, the dispersions are stirred and mixed in the second housing tank 322 by driving the second stirring device 352.

In the apparatus shown in FIG. 3, the first aggregated particles are first formed to form the first aggregated particle dispersion in the first housing tank 321, and the first aggregated particle dispersion is housed in the first housing tank 321. The first aggregated particles may be formed to prepare the first aggregated particle dispersion in another tank, and then the first aggregated particle dispersion may be housed in the first housing tank 321.

In this state, the first feed pump 341 and the second feed pump 342 are driven. By the drive, the second resin particle dispersion housed in the second housing tank 322 is fed to the first aggregated particle dispersion housed in the first housing tank 321. The dispersions are stirred and mixed in the first housing tank 321 by driving the first stirring device 351.

On the other hand, the third resin (binder resin) particle dispersion housed in the third housing tank 323 is fed to the second resin particle dispersion housed in the second housing tank 322. Then, the dispersions are stirred and mixed in the second housing tank 322 by driving the second stirring device 352.

In this case, the third resin particle dispersion is sequentially fed to the second resin particle dispersion housed in the second housing tank 322, and the concentration of the third resin particles is gradually increased. Therefore, the second housing tank 322 houses the mixed dispersion in which the second resin particles and the third resin particles are dispersed. The mixed dispersion is fed to the first aggregated particle dispersion housed in the first housing tank 321. The mixed dispersion is continuously fed while the concentration of the third resin (binder resin) particle dispersion in the mixed dispersion is increased.

By using the power feed addition method, the mixed dispersion in which the second resin particles and the third resin particles are dispersed can be added to the first aggregated particle dispersion while the concentration of the crystalline resin particles is adjusted.

In the power feed addition method, the distribution characteristic of crystalline resin domains of the toner particles can be adjusted by adjusting the feed start time and feed rate of the dispersion housed in each of the second housing tank 322 and the third housing tank 323. In the power feed addition method, the distribution characteristic of crystalline resin domains of the toner particles can also be adjusted by adjusting the feed rate during feeding of the dispersion housed in each of the second housing tank 322 and the third housing tank 323.

Specifically, the distribution characteristic is adjusted by the time of starting the feed of the third resin (binder resin) particle dispersion from the third housing tank 323 to the second housing tank 322. More specifically, for example, when the feed of the second resin (crystalline resin) particle dispersion from the second housing tank 322 to the first housing tank 321 is finished before finish of the feed from the third housing tank 323 to the second housing tank 322, the concentration of the crystalline resin particles in the mixed dispersion in the second housing tank 322 is decreased.

Also, the distribution characteristic is adjusted by, for example, the time of feeding the dispersion from each of the second housing tank 322 and the third housing tank 323 and the feed rate of the dispersion from the second housing tank 322 to the first housing tank 321. More specifically, for example, when the time of starting the feed of the third resin (binder resin) particle dispersion from the third housing tank 323 is advanced and the feed rate of the dispersion from the second housing tank 322 is decreased, the crystalline resin particles are in the state of being arranged up to the outer sides of the formed aggregated particles.

The power feed addition method is not limited to the methods described above. Examples which may be used include various methods such as 1) a method of separately providing a housing tank which houses the second resin particle dispersion and a housing tank which houses the mixed dispersion in which the second resin particle and third resin particle dispersions are dispersed, and feeding the dispersion to the first housing tank 321 from each of the housing tanks while changing the feed rate; a method of separately providing a housing tank which houses the third resin particle dispersion and a housing tank which houses the mixed dispersion in which the second resin particle and third resin particle dispersions are dispersed, and feeding the dispersion to the first housing tank 321 from each of the housing tanks while changing the feed rate; and the like.

The second aggregated particles are formed as described above, in which the second resin particles and third resin particles adhere to the surfaces of the first aggregated particles.

Formation of Third Aggregated Particle

Next, after the preparation of the second aggregated particle dispersion in which the second aggregated particles are dispersed, the second aggregated particle dispersion is further mixed with the fourth resin particle dispersion in which the fourth resin particles serving as the binder resin are dispersed.

The fourth resin particles may be the same as or different from the first or third resin particles.

Then, the fourth resin particles are aggregated on the surfaces of the second aggregated particles in the dispersion in which the second aggregated particles and the fourth resin particles are dispersed. Specifically, for example, when the second aggregated particles reach the target particle diameter in forming the second aggregated particles, the fourth resin particle dispersion is added to the second aggregated particle dispersion, and the resultant mixed dispersion is heated at a temperature equal to or lower than the glass transition temperature of the fourth resin particles.

Then, the proceeding of aggregation is terminated by adjusting the pH of the dispersion, for example, within a range of about 6.5 or more and 8.5 or less.

Fusion-Coalescence

Next, the third aggregated particles are fused and coalesced by heating the third aggregated particle dispersion in which the third aggregated particles are dispersed to, for example, a temperature equal to or higher than the glass transition temperatures of the first, third, and fourth resin particles (for example, a temperature of 10° C. to 30° C. higher than the glass transition temperatures of the first, third, and fourth resin particles), thereby forming the toner particles.

The toner particles are produced through the process described above.

After fusion-coalescence completed, dry toner particles are produced by a known method of washing, solid-liquid separation, and drying of the toner particles formed in the solution.

The washing is preferably performed by sufficient displacement washing with ion exchange water from the viewpoint of chargeability. The solid-liquid separation is not particularly limited but is preferably performed by suction filtration, pressure filtration, or the like from the viewpoint of productivity. The drying is not particularly limited but is preferably performed by freeze drying, flash drying, fluidized drying, vibration-type fluidized drying, or the like from the viewpoint of productivity.

The toner according to the exemplary embodiment of the present invention is produced by, for example, adding and mixing the external additives with the dry toner particles. Mixing may be performed by, for example, a V blender, a Henschel mixer, a Loedige mixer, or the like. Further, if required, coarse toner particles may be removed by using a vibrating sieve machine, an air sieve machine, or the like.

<Electrostatic Image Developer>

An electrostatic image developer according to an exemplary embodiment of the present invention contains at least the toner according to the exemplary embodiment of the present invention.

The electrostatic image developer according to the exemplary embodiment may be a one-component developer containing only the toner according to the exemplary embodiment or a two-component developer including a mixture of the toner and a carrier.

The carrier is not particularly limited, and a known carrier can be used. Examples of the carrier include a coated carrier which contains a core material including a magnetic powder and having a resin-coated surface; a magnetic powder-dispersed carrier which contains a magnetic powder mixed and dispersed in a matrix resin; a resin-impregnated carrier which contains a porous magnetic powder impregnated with a resin; and the like.

The magnetic powder-dispersed carrier and the resin-impregnated carrier may be a carrier which contains the constituent particles of the carrier as a core material and a coating resin on the surface of the core material.

Examples of the magnetic powder include powders of magnetic metals such as iron, nickel, cobalt, and the like; magnetic oxides such as ferrite, magnetite, and the like; and the like.

Examples of the coating resin and matrix resin include polyethylene, polypropylene, polystyrene, polyvinyl acetate, polyvinyl alcohol, polyvinyl butyral, polyvinyl chloride, polyvinyl ether, polyvinyl ketone, vinyl chloride-vinyl acetate copolymer, styrene-acrylic acid ester copolymer, a straight silicone resin containing an organosiloxane bond or modified products thereof, a fluorocarbon resin, polyester, polycarbonate, a phenol resin, an epoxy resin, and the like.

The coating resin and matrix resin may contain other additives such as conductive particles and the like.

Examples of the conductive particles include particles of metals such as gold, silver, copper, and the like, carbon black, titanium oxide, zinc oxide, tin oxide, barium sulfate, aluminum borate, potassium titanate, and the like.

The surface of the core material can be coated with the resin by, for example, a method of coating with a solution for forming a coating layer, which is prepared by dissolving the coating resin and various additives (used according to demand) in a proper solvent. The solvent is not particularly limited and may be selected in view of the type of the coating resin used, coatability, etc.

Examples of a resin coating method include a dipping method of dipping the core material in the solution for forming a coating layer; a spray method of spraying the solution for forming a coating layer on the surface of the core material; a fluidized bed method of spraying the solution for forming a coating layer on the core material in a state of being floated by fluidized air; a kneader/coater method of mixing the core material of the carrier with the solution for forming a coating layer in a kneader/coater and then removing the solvent; and the like.

The mixing ratio (mass ratio) of the toner to the carrier in the two-component developer is preferably toner carrier=1:100 to 30:100 and more preferably 3:100 to 20:100.

<Image Forming Apparatus and Image Forming Method>

An image forming apparatus and image forming method according an exemplary embodiment of the Present invention are described.

The image forming apparatus according the exemplary embodiment includes an image holding member, a charging unit which charges the surface of the image holding member, an electrostatic image forming unit which forms an electrostatic image on the charged surface of the image holding member, a developing unit which houses an electrostatic image developer and develops, as a toner image, the electrostatic image formed on the surface of the image holding member with the electrostatic image developer, a transfer unit which transfers the toner image formed on the surface of the image holding member to the surface of a recording medium, and a fixing unit which fixes the toner image transferred to the surface of the recording medium. The electrostatic image developer according to the exemplary embodiment is used as the electrostatic image developer.

The image forming apparatus according the exemplary embodiment performs an image forming method (the image forming method according to the exemplary embodiment) which includes charging the surface of the image holding member, forming an electrostatic image on the charged surface of the image holding member, developing as a toner image the electrostatic image formed on the surface of the image holding member with the electrostatic image developer according to the exemplary embodiment, transferring the toner image formed on the surface of the image holding member to the surface of a recording medium, and fixing the toner image transferred to the surface of the recording medium.

Examples of application of the image forming apparatus according to the exemplary embodiment include known image forming apparatuses such as an apparatus of a direct transfer system in which a toner image formed on the surface of an image holding member is transferred directly to a recording medium; an apparatus of an intermediate transfer system in which a toner image formed on the surface of an image holding member is first transferred to the surface of an intermediate transfer body and the toner image transferred to the surface of the intermediate transfer body is second transferred to the surface of a recording medium; an apparatus including a cleaning unit which cleans the surface of an image holding member before charging; an apparatus including an eliminating unit which eliminates electricity by applying eliminating light to the surface of an image holding member before charging; and the like.

When the image forming apparatus according to the exemplary embodiment is an apparatus of the intermediate transfer system, a configuration applied to the transfer unit includes, for example, an intermediate transfer body to the surface of which a toner image is transferred, a first transfer unit which first transfers the toner image formed on the surface of the image holding member to the surface of the intermediate transfer body, and a second transfer unit which second transfers the toner image transferred to the surface of the intermediate transfer body to the surface of the recording medium.

In the image forming apparatus according to the exemplary embodiment, for example, a part containing the developing unit may be a cartridge structure (process cartridge) detachable from the image forming apparatus. An example which is preferably used as the process cartridge is a process cartridge including the developing unit which houses the electrostatic image developer according to the exemplary embodiment.

The image forming apparatus according to the exemplary embodiment may be an image forming apparatus of a tandem system in which an image forming unit that forms a white toner image and at least one image forming unit that forms a colored toner image are arranged in parallel, or a monochrome image forming apparatus which forms only a white image. In the latter case, a white image is formed on a recording medium by the image forming apparatus according to the exemplary embodiment, and a colored image is formed on the recording medium by another image forming apparatus.

An example of the image forming apparatus according to the exemplary embodiment is described below, but the image forming apparatus is not limited to this example. In the description below, principal parts shown in the drawings are described, and other parts are not described.

FIG. 1 is a schematic configuration diagram showing the image forming apparatus according to the exemplary embodiment, which is an image forming apparatus of a quintuple-tandem intermediate transfer system.

The image forming apparatus shown in FIG. 1 includes the first to fifth image forming units 10Y, 10M, 10C, 10K, and 10W (image forming units) of an electrophotographic system which output images of the colors of yellow (Y), magenta (M), cyan (C), black (K), white (W) based on color-separated image data. The image forming units (may be simply referred to as the "units" hereinafter) 10Y, 10M, 10C, 10K, and 10W are arranged in parallel at predetermined spaces in the horizontal direction. These units 10Y, 10M, 10C, 10K, and 10W may be process cartridges detachable from the image forming apparatus.

In addition, an intermediate transfer belt (an example of the intermediate transfer body) 20 is extended below the units 10Y, 10M, 10C, 10K, and 10W so as to pass through the units. The intermediate transfer belt 20 is provided to be wound on a drive roller 22, a support roller 23, and a counter roller 24, which are disposed in contact with the inner surface of the intermediate transfer belt 20, so that the intermediate transfer belt 20 moves in the direction from the first unit 10Y to the fifth unit 10W. Further, an intermediate transfer body cleaning device 21 is provided on the image holding surface side of the intermediate transfer belt 20 so as to face the drive roller 22.

In addition, yellow, magenta, cyan, black, white toners contained in toner cartridges 8Y, 8M, 8C, 8K, and 8W are supplied to developing devices (an example of the developing unit) 4Y, 4M, 4C, 4K and 4W of the units 10Y, 10M, 10C, 10K, and 10W, respectively.

The first to fifth units 10Y, 10M, 10C, 10K, and 10W have the same configuration and operation and thus the first unit 10Y which forms a yellow image and disposed on the upstream side in the movement direction of the intermediate transfer belt is described as a representative.

The first unit 10Y has a photoreceptor 1Y functioning as the image holding member. Around the photoreceptor 1Y, there are sequentially provided a charging roller (an example of the charging unit) 2Y which charges the surface of the photoreceptor 1Y to a predetermined potential, an exposure device (an example of the electrostatic image forming unit) 3Y which forms an electrostatic image by exposure of the charged surface with a laser beam based on an image signal obtained by color separation, a developing device (an example of the developing unit) 4Y which develops the electrostatic image by supplying the toner to the electrostatic image, a first transfer roller (an example of the first transfer unit) 5Y which transfers the developed toner image to the intermediate transfer belt 20, and a photoreceptor cleaning device (an example of the cleaning unit) 6Y which removes the toner remaining on the surface of the photoreceptor 1Y after first transfer.

The first transfer roller 5Y is disposed on the inside of the intermediate transfer belt 20 and is provided at a position facing the photoreceptor 1Y. Further, a bias power supply (not shown) is connected to each of the first transfer rollers 5Y, 5M, 5C, 5K, and 5W of the respective units in order to apply a first transfer bias thereto. The value of transfer bias applied to each of the first transfer rollers from the bias power supply can be changed by control of a controller (not shown).

The operation of forming a yellow image in the first unit 10Y is described below.

First, before the operation, the surface of the photoreceptor 1Y is charged to a potential of −600 V to −800 V by the charging roller 2Y.

The photoreceptor 1Y is formed by laminating a photosensitive layer on a conductive (for example, a volume resistivity of $1\times10^{-6}$ Ω·cm or less at 20° C.) substrate. The photosensitive layer generally has high resistance (the resistance of a general resin) and has the property that when irradiated with a laser beam, the resistivity of a portion irradiated with the laser beam is changed. Thus, the charged surface of the photoreceptor 1Y is irradiated with a laser beam from the exposure device 3Y according to yellow image data sent from the controller (not shown). Therefore, an electrostatic image in a yellow image pattern is formed the surface of the photoreceptor 1Y.

The electrostatic image is an image formed on the surface of the photoreceptor 1Y by charging and is a so-called negative latent image formed by the laser beam from the exposure device 3Y, which causes the electrostatic charge flowing in the surface of the photoreceptor 1Y due to a decrease in resistivity of the irradiated portion of the photosensitive layer while the charge in a portion not irradiated with the laser beam remains.

The electrostatic image formed on the photoreceptor 1Y is rotated to a predetermined development position with travel of the photoreceptor 1Y. Then, at the development position, the electrostatic image on the photoreceptor 1Y is visualized as a toner image by the developing device 4Y.

For example, the electrostatic image developer containing at least the yellow toner and the carrier is housed in the developing device 4Y. The yellow toner is frictionally charged by stirring in the developing device 4Y and thus has a charge with the same polarity (negative polarity) as that of the electrostatic charge on the photoreceptor 1Y and is held on the developer roller (an example of the developer holding body). When the surface of the photoreceptor 1Y is passed through the developing device 4Y, the yellow toner electrostatically adheres to an electrostatically eliminated latent image on the surface of the photoreceptor 1Y, developing the latent image with the yellow toner. Then, the photoreceptor 1Y on which the yellow toner image has been formed is continuously traveled at a predetermined speed, and the toner image developed on the photoreceptor 1Y is conveyed to a predetermined first transfer position.

When the yellow toner image on the photoreceptor 1Y is conveyed to the first transfer position, the first transfer bias is applied to the first transfer roller 5Y, and electrostatic force to the first transfer roller 5Y from the photoreceptor 1Y is applied to the toner image. Thus, the toner image on the photoreceptor 1Y is transferred to the intermediate transfer belt 20. The transfer bias applied has a polarity (+) opposite to the polarity (−) of the toner and is controlled in the first unit 10Y to, for example, +10 μA by the controller (not shown).

On the other hand, the toner remaining on the photoreceptor 1Y is removed by the photoreceptor cleaning device 6Y and recovered.

The first transfer bias applied to each of the first transfer rollers 5M, 5C, 5K, and 5W of the second unit 10M and the later units is controlled according to the first unit 10Y.

Then, the intermediate transfer belt 20 to which the yellow toner image has been transferred in the first unit 10Y is sequentially conveyed through the second to fifth units 10M, 10C, 10K, and 10W to superpose the toner images of the respective colors by multi-layer transfer.

The intermediate transfer belt 20 to which the five color toner images have been transferred in multiple layers through the first to fifth units is reached to a second transfer part configurated by the intermediate transfer belt 20, the counter roller 24 in contact with the inner side of the intermediate transfer belt 20, and the second transfer roller (an example of the second transfer unit) 26 disposed on the image holding surface side of the intermediate transfer beat 20. Meanwhile, recording paper (an example of the recording medium) P is fed with predetermined timing, through a feeding mechanism, to a space in which the second transfer roller 26 is in contact with the intermediate transfer belt 20, and a second transfer bias is applied to the counter roller 24. The applied transfer bias has the same polarity (−) as the polarity (−) of the toner and electrostatic force acting toward the recording paper P from the intermediate transfer belt 20 is applied to the toner image to transfer the toner image on the intermediate transfer belt 20 to the recording paper P. During the second transfer, the second transfer bias is determined according to the resistance detected by a resistance detecting unit (not shown) which detects the resistance of the second transfer part and is voltage-controlled.

Then, the recording paper P is transported to a pressure-contact part (nip part) of a pair of fixing rollers in the fixing device (an example of the fixing unit) 28, and the toner image is fixed to the recording paper P, forming a fixed image.

Examples of the recording paper P to which the toner image is transferred include plain paper used for an electrophotographic copying machine, a printer, and the like Other than the recording paper P, an OHP sheet and the like can be used as the recording medium.

In order to further improve the smoothness of the image surface after fixing, the recording paper P has a smooth surface and, for example, coated paper formed by coating the surface of plain paper with a resin or the like, art paper for printing, or the like can be used.

The recording paper P after the completion of fixing of the color image is discharged to a discharge part, and a series of color image forming operations is finished.

<Process Cartridge and Toner Cartridge>

A process cartridge according to an exemplary embodiment of the present invention is described.

The process cartridge according to the exemplary embodiment is a process cartridge detachably mounted on the image forming apparatus and including a developing unit which houses the electrostatic image developer according to the exemplary embodiment and develops as the toner image the electrostatic image formed on the image holding member.

The process cartridge according to the exemplary embodiment may have a configuration including a developing unit and, if required, for example, at least one selected from other units such as an image holding member, a charging unit, an electrostatic image forming unit, and a transfer unit, etc.

An example of the process cartridge according to the exemplary embodiment is described below, but the process cartridge is not limited to this example. In the description below, principal parts shown in the drawings are described, but description of other parts omitted.

Figure 2:
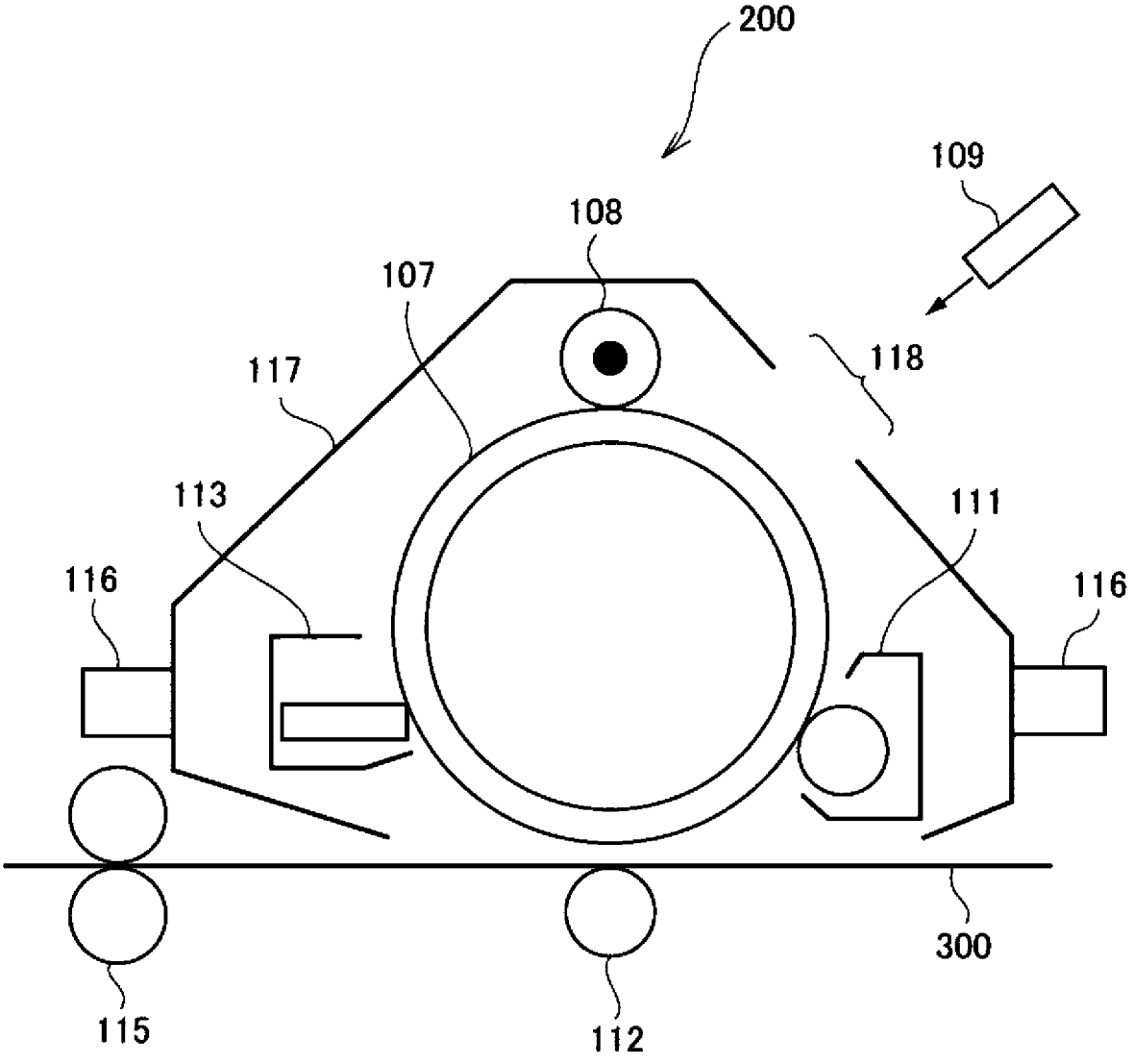
FIG. 2 is a schematic configuration diagram showing an example of a process cartridge according to an exemplary embodiment of the present invention.

FIG. 2 is a schematic configuration diagram showing the process cartridge according to the exemplary embodiment.

A process cartridge 200 shown in FIG. 2 is a cartridge with a configuration in which a photoreceptor 107 (an example of the image holding member) and a charging roller 108 (an example of the charging unit), a developing device 111 (an example of the developing unit), and a photoreceptor cleaning device 113 (an example of the cleaning unit), which are provided around the photoreceptor 107, are integrally held in combination by a housing 117 provided with a mounting rail 116 and an opening 118 for exposure.

In FIG. 2, reference numeral 109 denotes an exposure device (an example of the electrostatic image forming unit), reference numeral 112 denotes a transfer device (an example of the transfer unit), reference numeral 115 denotes a fixing device (an example of the fixing unit), and reference numeral 300 denotes recording paper (an example of the recording medium).

Next, a toner cartridge according to an exemplary embodiment of the present invention is described.

The toner cartridge according to the exemplary embodiment is a toner cartridge containing the white toner according to the exemplary embodiment and being detachable from the image forming apparatus. The toner cartridge is intended to contain the toner for replenishment to supply the toner to the developing unit provided in the image forming apparatus.

The image forming apparatus shown in FIG. 1 is an image forming apparatus having a configuration in which, toner cartridges 8Y, 8M, 8C, 8K, and 8W are detachably provided. Each of developing units 4Y, 4M, 4C, 4K, and 4W is connected to the toner cartridge of the corresponding color through a toner supply tube (not shown). Also, when, the amount of the toner contained in the toner cartridge is decreased, the toner cartridge is exchanged. An example of the toner cartridge according to the exemplary embodiment is the toner cartridge 8W and houses the white toner according to the exemplary embodiment. The yellow, magenta, cyan, and black toners are housed in the toner cartridges 8Y, 8M, 8C, and 8K, respectively.

EXAMPLES

Exemplary embodiments of the present invention are described in further detail below by giving examples and comparative examples, but the exemplary embodiments are not limited to these examples. In the description below, "parts" and "%" are on a mass basis unless particularly specified.

<Preparation of Resin Particle Dispersion>

(Preparation of Amorphous Polyester Resin Particle Dispersion (1))

Ethylene oxide 2.2-mole adduct of bisphenol A: 40 mol %

Propylene oxide 2.2-mole adduct of bisphenol A: 60 mol %

Terephthalic acid: 47 mol %

Fumaric acid: 40 mol %

Dodecenylsuccinic anhydride: 15 mol %

Timellitic anhydride: 3 mol %

In a reactor provided with a stirrer, a thermometer, a condenser, and a nitrogen gas inlet tube, the monomer components excluding fumaric acid and trimellitic anhydride described above and 0.25 parts of tin dioctanoate relative to a total of 100 parts of the monomer components are charged. The resultant mixture is reacted in a nitrogen gas stream at 235° C. for 6 hours and heated to 200° C., and then the fumaric acid and trimellitic anhydride are charged and reacted for 1 hour. The temperature is further increased to 220° C. over 4 hours, and polymerization is performed under a pressure of 10 kPa until a desired molecular weight is obtained, thereby producing a light-yellow transparent amorphous polyester resin.

The resultant amorphous polyester resin has a glass transition temperature Tg of 59° C. determined by DSC, a weight-average molecular weight Mw of 25,000 and a number-average molecular weight Mn of 7,000 determined by GPC, a softening temperature of 107° C. determined by a flow tester, and an acid value AV of 13 mgKOH/g.

In a 3-liter reaction tank (manufactured by Tokyo Rikakikai Co., Ltd.: BJ-30N) with a jacket, a condenser, a thermometer, a water dropping device, and an anchor wing, a mixed solvent of 160 parts of ethyl acetate and 100 parts of isopropyl alcohol is charged while the reaction tank is maintained at 40° C. in a water-circulating constant-temperature bath. Then, 300 parts of the amorphous polyester resin is added to the resultant mixture and dissolved by stirring at 150 rpm using a three-one motor to produce an oil phase. Then, 14 parts of a 10% aqueous ammonia solution was added dropwise to the oil phase under stirring over a dropping time of 5 minutes and mixed for 10 minutes, and then 900 parts of ion exchange water is further added dropwise at a rate of 7 parts per minute to cause phase inversion, thereby producing an emulsion.

Immediately, 800 parts of the emulsion and 700 parts of ion exchange water are placed in a 2-liter eggplant-shaped flask which is then set to an evaporator (Tokyo Rikakikai Co., Ltd.) provided with a vacuum control unit through a trap bulb. The flask is heated in a hot water bath of 60° C. while being rotated, and the solvent is removed by reducing the pressure to 7 kPa while giving attention to bumping. When the amount of the solvent recovered is 1,100 parts, the pressure is returned to normal pressure, and the eggplant-shaped flask is cooled with water to produce a dispersion. The result dispersion has no solvent odor. The volume-average particle diameter of the resin particles in the dispersion is 130 nm.

Then, the solid content concentration is adjusted to be 20% by adding ion exchange water, and the resultant dispersion is referred to as an "amorphous polyester resin dispersion (1)".

(Preparation of Crystalline Polyester Resin Particle Dispersion (2))

1,10-Dodecanedioic acid: 50 mol %

1,6-Hexanediol: 50 mol %

In a reactor provided with a stirrer, a thermometer, a condenser, and a nitrogen gas inlet tube, the monomer components described above are added, and the reactor is purged with dry nitrogen gas. Then, 0.25 parts of titanium tetra butoxide (reagent) relative to 100 parts of the monomer components is added. After reaction under stirring at 170° C. for 3 hours in a nitrogen gas stream, the temperature is further increased to 210° C. over 1 hour, and the pressure in the reactor is reduced to 3 pKa. Reaction is performed for 13 hours under the reduced pressure to produce a crystalline polyester resin (2).

The resultant crystalline polyester resin (2) has a melting temperature of 73.6° C. determined by DSC, a weight-average molecular weight Mw of 25,000 and a number-average molecular weight Mn of 10,500 determined by GPC, and an acid value AV of 10.1 mgKOH/g.

In a 3-liter reaction tank (manufactured by Tokyo Rikakikai Co., Ltd.: BJ-30N) with a jacket, a condenser, a thermometer, a water dropping device, and an anchor wing, 300 parts of the crystalline polyester resin (2), 160 parts of methyl ethyl ketone (solvent), and 100 parts of isopropyl alcohol (solvent) are placed, and the resin is dissolved under stirring and mixing at 100 rpm while being maintained at 70° C. in a water-circulating constant-temperature bath.

Then, the number of stirring rotations is changed to 150 rpm, and the water circulating constant-temperature bath is set to 66° C. Then, 17 parts of a 10% aqueous ammonia solution (reagent) was added over 10 minutes, and then a total of 900 parts of ion exchange water kept warm at 66° C. is added dropwise at a rate of 7 parts/minute to cause phase inversion, thereby producing an emulsion.

Immediately, 800 parts of the emulsion and 700 parts of ion exchange water are placed in a 2-liter eggplant-shaped flask which is then set to an evaporator (Tokyo Rikakikai Co., Ltd.) provided with a vacuum control unit through a trap bulb. The flask is heated in a hot water bath of 60° C. while being rotated, and the solvent is removed by reducing the pressure to 7 kPa while giving attention to bumping. When the amount of the solvent recovered is 1,100 parts, the Pressure is returned to normal pressure, and the eggplant-shaped flask is cooled with water to produce a dispersion. The result dispersion has no solvent odor. The volume-average particle diameter of the resin particles in the dispersion is 130 nm. Then, the solid content concentration is adjusted to be 20% by adding ion exchange water, and the resultant dispersion is referred to as a "crystalline polyester resin dispersion (2)".

(Preparation of White Pigment Particle Dispersion)

Titanium oxide (CR-60-2: manufactured by Ishihara Sangyo Kaisha, Ltd.): 100 parts Nonionic surfactant (Nonipol 400, manufactured by Sanyo Chemical Industries, Ltd.): 10 parts Ion exchange water: 400 parts These components are mixed and stirred for 30 minutes by using a homogenizer (Ultra-Turrax T50, manufactured by IKA Corporation) and then dispersed for 1 hour by using a high-pressure collision-type disperser Ultimaizer (HJP 30006, manufactured by Sugino Machine Ltd.) to prepare a white pigment particle dispersion (sold content: 20%) in which a white pigment having a volume-average particle diameter of 210 nm is dispersed.

(Preparation of Mold Release Agent Particle Dispersion)

Polyethylene wax (manufactured by Toyo Adl Corporation, product name: PW655, melting temperature: 97° C.) 50 parts Anionic surfactant (Neogen RK, manufactured by Daiichi Kogyo Seiyaku Co., Ltd.): 1.0 parts Sodium chloride (manufactured by Wako Pure Chemical industries, Ltd.): 5 parts Ion exchange water: 200 parts These components are mixed and heated to 95° C., and the mixture is dispersed by using a homogenizer (Ultra-Turrax T50, manufactured by IKA Corporation) and then dispersed for 360 minutes by using a Manton-Gorlin high pressure homogenizer (manufactured by Gorlin Co., Ltd.), thereby preparing a mold release agent particle dispersion (solid content concentration: 20%) in which a mold release agent having a volume-average particle diameter of 0.23 μm is dispersed.

Example 1

<Preparation of White Toner>

(Formation of White Toner Particles)

Amorphous polyester resin particle dispersion (1): 45 parts

Crystalline polyester resin particle dispersion (2): 30 parts

White pigment particle dispersion: 195 parts

Wild release agent particle dispersion: 50 parts

Ion exchange water: 450 parts

Anionic surfactant (Tayca Power manufactured by Tayca Corporation): 2 parts

An apparatus having the same configuration as shown in FIG. 3 and used for the power feed addition method is prepared.

The materials described above are placed in a round-bottom stainless-made flask (the first housing tank 321 in FIG. 3) and adjusted to pH 3.5 by adding 0.1N nitric acid, and then 30 parts of an aqueous nitric acid solution at an aluminum polychloride concentration of 10% by mass is added to the flask. Then, the resultant mixture is dispersed at 30° C. by using a homogenizer (Ultra-Turrax T50, manufactured by IKA Corporation) and then aggregated particles A are grown by heating at a rate of 1° C./30 minutes in a heating oil bath.

On the other hand, 70 parts of the crystalline polyester resin particle dispersion (2) is placed in a polyester bottle container (the second housing tank 322 in FIG. 3).

Next, the temperature in the round-bottom stainless-made flask is increased at 1° C./min during the formation of the aggregated particles A. When the particle diameter of the aggregated particles A is 3.0 μm, a tube pump (the first feed pump 341 in FIG. 3) is driven at a feed rate set to 2 parts/min, and the dispersion is fed.

At the same time as the start of feeding of the crystalline polyester resin particle dispersion (2) to the flask (the first housing tank 321), 110 parts of the amorphous polyester resin particle dispersion (1) is placed in the polyester bottle container (the third housing tank 323). In this case, a tube pump (the second feed pump 342 in FIG. 3) is driven at a feed rate set to 1 part/min, and the dispersion is fed.

Then, when the particle diameter of the aggregated particles A reaches 7.5 μm, feeding by the tube pump (the second feed pump 342) is terminated, and the tube pump (the first feed pump 341) is driven at a feed rate set to 10 parts/min, and the dispersion is fed. After the feed from the polyester bottle container (the second housing tank 322 in FIG. 3) is completed, the tube pump (the second feed pump 342) is driven at a feed rate set to 10 parts/min, and the dispersion is fed.

After the feeding to the flask is completed, the temperature is increased by 1° C. and maintained under stirring for 30 minutes to form aggregated particles.

Then, the resultant mixture is adjusted to pH 8.5 by adding a 0.1 N aqueous sodium hydroxide solution, then heated to 85° C. under continuous stirring, and maintained for 3 hours. Then, the mixture is cooled to 20° C. at a rate of 20° C./min and filtered, and the residue is sufficiently washed with ion exchange water and dried to produce toner particles (1) having a volume-average particle diameter of 8.0 μm.

(Formation of White Toner)

First, 100 parts of the toner particles (1) and 0.7 parts of dimethyl silicone oil-treated silica particles (RY200 manufactured by Nippon Aerosil Co., Ltd.) are mixed by using a Henschel mixture to produce a white toner (1)

(Formation of Developer)

Ferrite particle (average particle diameter: 50 μm): 100 parts

Toluene: 14 parts

Styrene/methyl methacrylate copolymer (copolymerization ratio: 15/85): 3 parts

Carbon black: 0.2 parts

These components excluding the ferrite particles are dispersed by using a sand mill to prepare a dispersion, and the resultant dispersion is placed together with the ferrite particles in a vacuum degassing kneader and dried at reduced pressure under stirring, thereby producing a carrier.

A developer (1) is produced by mixing 8 parts of the white toner (1) with 100 parts of the carrier.

Example 2

White toner particles, a white toner, and a developer are produced by the same method as in Example 1 except that in forming the white toner particles in Example 1, the amount of the crystalline polyester resin particle dispersion (2) placed in the polyester bottle container (the second housing tank 322) is changed to 20 parts, the feed rate of the tube pump (the first feed pump 341) for feeding to the flask (the first housing tank 321) is changed to 5 parts/min, and the amount of the amorphous polyester resin particle dispersion (1) placed in the polyester bottle container (the third housing tank 323) is changed to 160 parts.

Example 3

White toner particles, a white toner, and a developer are produced by the same method as in Example 1 except that in forming the white toner particles in Example 1, the amount of the crystalline polyester resin particle dispersion (2) placed in the polyester bottle container (the second housing tank 322) is changed to 80 parts, the feed rate of the tube pump (the first feed pump 341) for feeding to the flask (the first housing tank 321) is changed to 1.5 parts/min, and the amount of the amorphous polyester resin particle dispersion (1) placed in the polyester bottle container (the third housing tank 323) is changed to 100 parts.

Example 4

White toner particles, a white toner, and a developer are produced by the same method as in Example 1 except that in forming the white toner particles in Example 1, the amount of the crystalline polyester resin particle dispersion (2) placed in the polyester bottle container (the second housing tank 322) is changed to 90 parts, the feed rate of the tube pump (the first feed pump 341) for feeding to the flask (the first housing tank 321) is changed to 1 particle dispersion (1) placed in the polyester bottle container (the third housing tank 323) is changed to 90 parts.

Example 5

White toner particles, a white toner, and a developer are produced by the same method as in Example 1 except that in forming the white toner particles in Example 1, the amount of the crystalline polyester resin particle dispersion (2) placed in the polyester bottle container (the second housing tank 322) is changed to 15 parts, the feed rate of the tube pump (the first feed pump 341) for feeding to the flask (the first housing tank 321) is changed to 7 parts/min, and the amount of the amorphous polyester resin particle dispersion (1) placed in the polyester bottle container (the third housing tank 323) is changed to 165 parts.

Example 6

White toner particles, a white toner, and a developer are produced by the same method as in Example 1 with the following exception when forming the white toner particles in Example 1.

Amorphous polyester resin particle dispersion (1) placed in the flask (the first housing tank 321): 45 parts Crystalline polyester resin particle dispersion (2) placed in the flask (the first housing tank 321): 30 parts Crystalline polyester resin particle dispersion (2) placed in the polyester bottle container (the second housing tank 322): 40 parts Amorphous polyester resin particle dispersion (1) placed in the polyester bottle container (the third housing tank 323): 155 parts Example 7

White toner particles, a white toner, and a developer are produced by the same method as in Example 1 with the following exception when forming the white toner particles in Example 1.

Amorphous polyester resin particle dispersion (1) placed in the flask (the first housing tank 321): 10 parts Crystalline polyester resin particle dispersion (2) placed in the flask (the first housing tank 321): 40 parts Crystalline polyester resin particle dispersion (2) placed in the polyester bottle container (the second housing tank 322): 80 parts Amorphous polyester resin particle dispersion (1) placed in the polyester bottle container (the third housing tank 323): 100 parts Example 8

A crystalline polyester resin particle dispersion is prepared by the same method as in Example 1, and a white toner and a developer are produced by the same method as in Example 1 except that in preparing the crystalline polyester resin particle dispersion (2) used in Example 1, the materials are changed as follows.

1,10-Dodecanedioic acid: 50 mol %

1,9-Nonanediol: 50 mol %

Example 9

A crystalline polyester resin particle dispersion is prepared by the same method as in Example 1, and a white toner and a developer are produced by the same method as in Example 1 except that in preparing the crystalline polyester resin particle dispersion (2) used in Example 1, the number of stirring rotations is changed to 300 rpm after the crystalline polyester resin is dissolved under stirring and mixing.

Example 10

A crystalline polyester resin particle dispersion is prepared by the same method as in Example 1, and a white toner and a developer are produced by the same method as in Example 1 except that in preparing the crystalline polyester resin particle dispersion (2) used in Example 1, the number of stirring rotations is changed to 100 rpm after the crystalline polyester resin is dissolved under stirring and mixing.

Comparative Example 1

<Preparation of White Toner>

Amorphous polyester resin particle dispersion (1): 155 parts

Crystalline polyester resin particle dispersion (2): 100 parts

White pigment particle dispersion: 195 parts

Mold release agent particle dispersion: 50 parts

Ion exchange water: 450 parts

Anionic surfactant (Tayca Power manufactured by Tayca Corporation): 2 parts

The materials described above are placed in a round-bottom stainless-made flask and adjusted to pH 3.5 by adding 0.1N nitric acid, and then 30 parts of an aqueous nitric acid solution at an aluminum polychloride concentration of 10% by mass is added to the flask. Then, the resultant mixture is dispersed at 30° C. by using a homogenizer (Ultra-Turrax T50, manufactured by IKA Corporation) and then aggregated particles A are grown by heating at a rate of 1° C./30 minutes in a heating oil bath (formation of aggregated particles).

Then, 100 parts of the amorphous polyester resin particle dispersion (1) is slowly added, and the resultant mixture is maintained for 1 hour and adjusted to pH 7.5 adding a 0.1 N aqueous sodium hydroxide solution. Then, the mixture is heated to 92° C. under continuous stirring and maintained for 5 hours. Then, the mixture is cooled to 20° C. at a rate of 20° C./min and filtered, and the residue is sufficiently washed with ion exchange water and dried to produce white toner particles having a volume-average particle diameter of 9.0 μm (fusion-coalescence). Then, a white developer is produced by the same method as in Example 1.

Comparative Example 2

White toner particles, a white toner, and a developer are produced by the same method as in Example 1 except that in forming the white toner particles in Example 1, the amount of the crystalline polyester resin particle dispersion (2) placed in the polyester bottle container (the second housing tank 322) is changed to 15 parts, the feed rate of the tube pump (the first feed pump 341) for feeding to the flask (the first housing tank 321) is changed to 8 parts/min, and the amount of the amorphous polyester resin particle dispersion (1) placed in the polyester bottle container (the third housing tank 323) is changed to 180 parts.

Comparative Example 3

<Formation of White Toner Particles (B1)>

(Method for Producing Crystalline Polyester Resin (B1))

In a three-neck flask dried by heating, 98 mol % of dimethyl tetradecanedioate, 2 mol % of sodium dimethyl isophthalate-5-sulfonate, 100 mol % of 1,8-octaediol, and 0.3 parts of dibutyl tin oxide are placed, and the air in the flask is replaced by an inert atmosphere of nitrogen gas by a pressure reducing operation. Then, the resultant mixture is stirred by mechanical stirring under reflux at 180° C. for 5 hours. Then, the temperature is gradually increased to 230° C. under reduced pressure, followed by stirring for 2 hours. When a viscous state is obtained, reaction is terminated by air-cooling, and then the reaction product is dried to synthesize a crystalline polyester resin (B1). As a result of molecular weight measurement (in terms of polystyrene) by gel permeation chromatography, the resultant crystalline polyester resin. (B1) has physical properties that Tg=64° C., Mn=4600, and Mw=9700.

(Formation of White Toner)

Crystalline polyester resin (B1) 20 parts

Amorphous polyester resin: 42 parts (linear polyester produced by polycondensation of terephthalic acid/bisphenol A ethylene oxide adduct/cyclohexane dimethanol, Tg 62° C., Mn=4,000, and Mw=12,000)

Titanium oxide (CR60: manufactured by Ishihara Sangyo Kaisha, Ltd.): 30 parts

Paraffin wax HNP9 (melting temperature 75° C.: manufactured by Nippon Seiro Co Ltd.) 8 parts The components described above are sufficient pre-mixed by a Henschel mixer, melt-kneaded by a biaxial roll mill, finely ground by a jet mill after cooling, and further classified two times by a pneumatic classifier to form white toner particles (B1) having a volume-average particle diameter of 7.0 μm and a coloring agent concentration of 30%.

Then, a white developer and a developer are produced by the same method as in Example 1.

Comparative Example 4

<Formation of White Toner Particles (B2) by Grinding Method>

White toner particles (B2) are produced by a kneading-grinding method.

Specifically, 20 parts of a crystalline polyester resin (the crystalline polyester resin synthesized for preparing the crystalline polyester resin particle dispersion (2)) and 40 parts of titanium oxide particles are added to 40 parts of an amorphous polyester resin (the amorphous polyester resin synthesized for preparing the amorphous polyester resin particle dispersion (1)), and the resultant mixture is kneaded by a pressure kneader. The resultant kneaded material is roughly ground to form white toner particles (B2) having a volume-average particle diameter of 9.0 mm. Then, a white developer and a developer are produced by the same method as in Example 1.

Comparative Example 5

White toner particles, a white toner, and a developer are produced by the same method as in Example 1 with the following exception when forming the white toner particles in Example 1.

Amorphous polyester resin particle dispersion (1) placed in the flask (the first housing tank 321): 100 parts Crystalline polyester resin particle dispersion (2) placed in the flask (the first housing tank 321): 30 parts Crystalline polyester resin particle dispersion (2) placed in the polyester bottle container (the second housing tank 322) 10 parts Amorphous polyester resin particle dispersion (1) placed in the polyester bottle container (the third housing tank 323): 180 parts Comparative Example 6

White toner particles, a white toner, and a developer are produced by the same method as in Example 1 with the following exception when forming the white toner particles in Example 1.

Amorphous polyester resin particle dispersion (1) placed in the flask (the first housing tank 321): 30 parts Crystalline polyester resin particle dispersion (2) placed in the flask (the first housing tank 321): 40 parts Crystalline polyester resin particle dispersion (2) placed in the polyester bottle container (the second housing tank 322): 120 parts Amorphous polyester resin particle dispersion (1) placed in the polyester bottle container (the third housing tank 323): 50 parts Comparative Example 7

A crystalline polyester resin particle dispersion is prepared by the same method as in Example 1, and a white toner and a developer are produced by the same method as in Example 1 except that in preparing the crystalline polyester resin particle dispersion (2) used in Example 1, the number of stirring rotations is changed to 500 rpm after the crystalline polyester resin is dissolved under stirring and mixing.

Comparative Example 8

A crystalline polyester resin particle dispersion is prepared by the same method as in Example 1, and a white toner and a developer are produced by the same method as in Example 1 except that in preparing the crystalline polyester resin particle dispersion (2) used in Example 1, the number of stirring rotations is changed to 50 rpm after the crystalline polyester resin is dissolved under stirring and mixing.

Comparative Example 9

A crystalline polyester resin particle dispersion is prepared by the same method as in Example 1 except that in preparing the crystalline polyester resin particle dispersion (2) used in Example 1, the number of stirring rotations is changed to 700 rpm after the crystalline polyester resin is dissolved under stirring and mixing.

Also, white toner particles, a white toner, and a developer are produced by the same method as in Example 1 except that in forming the white toner particles in Example 1, the amount of the crystalline polyester resin particle dispersion produced as described above and placed in the polyester bottle container (the second housing tank 322) is changed to 120 parts, the feed rate of the tube pump (the first feed pump 341) for feeding to the flask (the first housing tank 321) is changed to 1 parts/min, and the amount of the amorphous polyester resin particle dispersion (1) placed in the polyester bottle container (the third housing tank 323) is changed to 60 parts.

The following physical properties of each of the resultant white toners are measured by the methods described above. The obtained, results are shown in Table 1 below.

"Loss tangent tan δ at 30° C." of toner

"Storage modulus G' at 30° C." of toner

"SP value of crystalline polyester resin"

"SP value of amorphous polyester resin"

"Difference in SP value between, crystalline polyester resin and amorphous polyester rein"

"Content of crystalline polyester resin in toner particles"

"Content of amorphous polyester resin in toner particles"

"Ratio (Cr/Am) of content (Cr) of crystalline polyester resin to content (Am) of amorphous polyester resin in toner particles"

"Content of white pigment in toner particles"

"Diameter of resin particles" in crystalline polyester resin particle dispersion

[Evaluation Method]

A sample for evaluating fixing, and image quality is formed by using a modified machine of Docu Centre IV C5575 (Manufactured by Fuji Xerox Co., Ltd.) and a modified machine of Color 1000 Press (manufactured by Fuji Xerox Co., Ltd.).

(Evaluation of Image Hiding Properties)

A solid image (TMA=10 g/m$^2$) is formed on an OHP film (manufactured by Fuji Xerox Co., Ltd.), and a black portion of JIS contrast test paper (manufactured by Motofuji Co., Ltd.) is placed below the 2000th sample image obtained. The L* value of the image is measured by using an image densitometer (X-Rite 404A, manufactured by X-Rite, Inc.) and evaluated according to the following criteria.

A: L* of 83 or more

B: L* of 80 or more and less and 83

C: L* of less than 80

(Image Strength)

A 2000th sample image is obtained as described above and scratched at points with a load of 3.0 N by using a scratch hardness tester (318-S: manufactured by ERICHSEN Inc.). The degree of defect is visually observed and evaluated according to the following criteria.

A: Only the surface is scratched without image defect.

B: The image is partially defected.

C: A half or more of the image is defected.

TABLE 1

| | | Toner | | SP value | | | Content in toner particle [% by mass] | | | | Resin particle | Evaluation | |
|---|---|---|---|---|---|---|---|---|---|---|---|---|---|
| | | tanδ | G' [Pa] | Crystalline polyester resin | Amorphous polyester resin | Difference between crystalline and amorphous polyester resins | Crystalline polyester resin (Cr) | Amorphous polyester resin (Am) | Ratio (Cr/Am) | White pigment | diameter in crystalline polyester dispersion [nm] | Hiding properties | Fix level |
| Example | 1 | 0.46 | $2.2 \times 10^8$ | 9.1 | 10.1 | 1 | 18 | 30 | 0.60 | 40 | 130 | A (○) | A (○) |
| | 2 | 0.21 | $3.8 \times 10^8$ | 9.1 | 10.1 | 1 | 14 | 37 | 0.38 | 40 | 130 | B (Δ) | B (Δ) |
| | 3 | 0.9 | $1.5 \times 10^8$ | 9.1 | 10.1 | 1 | 17 | 35 | 0.49 | 40 | 130 | B (Δ) | A (○) |
| | 4 | 0.92 | $1.2 \times 10^8$ | 9.1 | 10.1 | 1 | 20 | 30 | 0.67 | 40 | 130 | B (Δ) | A (○) |
| | 5 | 0.21 | $4.7 \times 10^8$ | 9.1 | 10.1 | 1 | 10 | 40 | 0.25 | 40 | 130 | B (Δ) | B (Δ) |
| | 6 | 0.25 | $3.8 \times 10^8$ | 9.1 | 10.1 | 1 | 7 | 45 | 0.16 | 40 | 130 | B (Δ) | B (Δ) |
| | 7 | 0.85 | $1.9 \times 10^8$ | 9.1 | 10.1 | 1 | 23 | 28 | 0.82 | 40 | 130 | A (○) | A (○) |
| | 8 | 0.5 | $2.0 \times 10^8$ | 9 | 10.1 | 1.1 | 18 | 30 | 0.60 | 40 | 130 | B (Δ) | B (Δ) |
| | 9 | 0.46 | $2.2 \times 10^8$ | 9.1 | 10.1 | 1 | 18 | 30 | 0.60 | 40 | 70 | B (Δ) | A (○) |
| | 10 | 0.46 | $2.2 \times 10^8$ | 9.1 | 10.1 | 1 | 18 | 30 | 0.60 | 40 | 350 | B (Δ) | A (○) |
| Comparative Example | 1 | 0.15 | $5.0 \times 10^8$ | 9.1 | 10.1 | 1 | 18 | 30 | 0.60 | 40 | 130 | C (x) | C (x) |
| | 2 | 0.19 | $6.0 \times 10^8$ | 9.1 | 10.1 | 1 | 7 | 45 | 0.16 | 40 | 130 | C (x) | C (x) |
| | 3 | 0.18 | $4.7 \times 10^8$ | 8.9 | 10.1 | 1.2 | 20 | 30 | 0.67 | 30 | 130 | B (Δ) | C (x) |
| | 4 | 1.1 | $0.8 \times 10^8$ | 9.1 | 10.1 | 1 | 20 | 33 | 0.61 | 40 | 130 | C (x) | B (Δ) |
| | 5 | 0.17 | $4.0 \times 10^8$ | 9.1 | 10.1 | 1 | 4 | 47 | 0.09 | 40 | 130 | C (x) | C (x) |
| | 6 | 1.12 | $1.4 \times 10^8$ | 9.1 | 10.1 | 1 | 30 | 25 | 1.20 | 40 | 130 | C (x) | B (Δ) |
| | 7 | 0.17 | $4.0 \times 10^8$ | 9.1 | 10.1 | 1 | 20 | 30 | 0.67 | 40 | 35 | C (x) | A (○) |
| | 8 | 1.2 | $2.0 \times 10^8$ | 9.1 | 10.1 | 1 | 20 | 30 | 0.67 | 40 | 500 | C (x) | B (Δ) |
| | 9 | 1.4 | $0.8 \times 10^8$ | 9.1 | 10.1 | 1 | 20 | 30 | 0.67 | 40 | 15 | C (x) | A (○) |

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined the following claims and their equivalents.

What is claimed is:

1. A white toner for electrostatic image development, the toner comprising:

toner particles containing a binder resin, which contains at least a crystalline polyester resin and an amorphous polyester resin, and a white pigment, wherein a loss tangent tan δ at 30° C. determined by dynamic viscoelasticity measurement is 0.2 or more and 1.0 or less, and wherein the crystalline polyester resin is formed from dodecanedioic acid and hexanediol.

2. The white toner for electrostatic image development according to claim 1, wherein the loss tangent tan δ is 0.3 or more and 0.9 or less.

3. The white toner for electrostatic image development according to claim 1, wherein a storage modulus G' at 30° C. determined by dynamic viscoelasticity measurement is $1.0\times10^8$ Pa or more and $5.0\times10^8$ Pa or less.

4. The white toner for electrostatic image development according to claim 3, wherein the storage modulus G' is $1.5\times10^8$ Pa or more and $4.5\times10^8$ Pa or less.

5. The white toner for electrostatic image development according to claim 1, wherein a content of the crystalline polyester resin in the toner particles is 5% by mass or more and 25% by mass or less, and a content of the amorphous polyester resin in the toner particles is 20% by mass or more and 80% by mass or less.

6. The white toner for electrostatic image development according to claim 5, wherein the content of the crystalline polyester resin in the toner particles is 7% by mass or more and 23% by mass or less, and the content of the amorphous polyester resin in the toner particles is 25% by mass or more and 75% by mass or less.

7. The white toner for electrostatic image development according to claim 1, wherein a ratio (Cr/Am) of the content [Cr] of the crystalline polyester resin to the content [Am] of the amorphous polyester resin in the toner particles is 0.15 or more and 0.90 or less.

8. The white toner for electrostatic image development according to claim 1, wherein a difference in SP value between the crystalline polyester resin and the amorphous polyester resin is 0.8 or more and 1.1 or less.

9. The white toner for electrostatic image development according to claim 1, wherein a content of the white pigment in the toner particles is 15% by mass or more and 45% by mass or less.

10. The white toner for electrostatic image development according to claim 1, wherein the white pigment contains titanium oxide.

11. An electrostatic image developer comprising the white toner for electrostatic image development according to claim 1.

12. A toner cartridge housing the white toner for electrostatic image development according to claim 1 and being detachable from an image forming apparatus.

13. The white toner for electrostatic image development according to claim 1, wherein the white toner is formed by way of a power feed addition method, the power feed addition method carried out via a plurality of tanks and a pump, at least one of the plurality of tanks containing the crystalline polyester resin and at least another one of the plurality of tanks containing at least the amorphous polyester resin, wherein the pump is linked to at least one of the tanks in the plurality of tanks, and the pump is controlled to adjust a feed start time and/or feed rate of the crystalline polyester resin to at least one of the tanks in the plurality of tanks.

* * * * *